US009247829B2

(12) United States Patent
Wyler et al.

(10) Patent No.: US 9,247,829 B2
(45) Date of Patent: Feb. 2, 2016

(54) PORTABLE DIAPER CHANGING STATION

(71) Applicant: Rebecca Leigh Wyler, Pleasant Hill, CA (US)

(72) Inventors: Rebecca Leigh Wyler, Pleasant Hill, CA (US); George Cook, Crestview, FL (US)

(73) Assignee: Rebecca Leigh Wyler, Pleasant Hill, CA (US)

( * ) Notice: Subject to any disclaimer, the term of this patent is extended or adjusted under 35 U.S.C. 154(b) by 0 days.

(21) Appl. No.: 14/634,601

(22) Filed: Feb. 27, 2015

(65) Prior Publication Data

US 2015/0296998 A1 Oct. 22, 2015

Related U.S. Application Data

(60) Provisional application No. 61/982,100, filed on Apr. 21, 2014.

(51) Int. Cl.
*A47D 5/00* (2006.01)

(52) U.S. Cl.
CPC . *A47D 5/006* (2013.01); *A47D 5/00* (2013.01)

(58) Field of Classification Search
CPC ..... A47D 5/00; A47D 5/006
USPC ..... 5/655, 110, 111
See application file for complete search history.

(56) References Cited

U.S. PATENT DOCUMENTS

| | | | | | |
|---|---|---|---|---|---|
| 1,426,160 | A | * | 8/1922 | Driver | 108/26 |
| 3,462,773 | A | * | 8/1969 | Triplett | 5/111 |
| 3,646,895 | A | | 3/1972 | Campbell | |
| 5,067,417 | A | * | 11/1991 | Marmentini et al. | 108/36 |
| 5,299,336 | A | * | 4/1994 | Marteeny | 5/655 |
| D367,771 | S | * | 3/1996 | Julian | D6/333 |
| 5,926,881 | A | * | 7/1999 | Madison | 5/655 |
| 6,298,509 | B1 | * | 10/2001 | Vickers | 5/655 |
| 6,389,624 | B1 | * | 5/2002 | Madole | 5/655 |
| 8,480,114 | B1 | | 7/2013 | Grantz | |
| 2006/0174415 | A1 | | 8/2006 | Moulton | |
| 2006/0225216 | A1 | | 10/2006 | Thibodeaux | |
| 2011/0023232 | A1 | | 2/2011 | Sun | |

FOREIGN PATENT DOCUMENTS

| | | | | | |
|---|---|---|---|---|---|
| EP | 2057920 | | 5/2006 | | |
| GB | 1083811 | A | * | 9/1967 | A47D 5/00 |

* cited by examiner

*Primary Examiner* — Michael Trettel
(74) *Attorney, Agent, or Firm* — Fish & Richardson P.C.

(57) ABSTRACT

A portable diaper changing station includes a platform structure having a top that defines a baby changing surface configured for receiving and supporting a baby during a diaper changing process. A support structure is connected to and configured for supporting the platform structure. The support structure is extendable from a storage position to a first extended position suitable for supporting the platform structure at a first height and a second extended position suitable for supporting the platform structure at a second height that is greater than the first height.

20 Claims, 19 Drawing Sheets

PORTABLE DIAPER CHANGING STATION

CROSS REFERENCE TO RELATED APPLICATIONS

This application claims the benefit of U.S. Provisional Application Ser. No. 61/982,100, filed Apr. 21, 2014, the content of which is incorporated herein by reference in its entirety.

TECHNICAL FIELD

This invention relates to baby care products, and more particularly to a diaper changing station for use in changing a diaper of a baby.

BACKGROUND

Changing baby diapers is a common task of parents and other caregivers, and typically needs to be performed several times per day. In some cases, caregivers will use a diaper changing station as part of the diaper changing process. For example, a caregiver might set a baby on a changing area of a diaper changing station to support the baby during the changing process. In some cases, diaper changing stations can be pieces of furniture, or integrated with a piece of furniture, which can make it difficult or impossible for the caregiver to take the changing station with when leaving the home. Caregivers can also change a baby's diaper by placing the baby on the floor or another surface, but doing so can cause the diaper changing process to be more challenging.

SUMMARY

In general, one innovative aspect of the subject matter described in this specification can be embodied in a portable diaper changing station that includes a rigid housing. The rigid housing can be defined by an exterior surface and have a housing top and a housing bottom spaced from the housing top by a height. The housing top can define a baby changing surface configured for receiving and supporting a baby during a diaper changing process. The rigid housing can include a first module having a first module top defining a first portion of the baby changing surface and having a first module bottom opposite the first module top, and a second module having a second module top defining a second portion of the baby changing surface and having a second module bottom opposite the second module top. The first module can be hingedly connected to the second module so as to be movable from an open position to a folded position. The first portion of the baby changing surface can be aligned with the second portion of the baby changing surface so as to be suitable for receiving and supporting a baby during a diaper changing process when in the open position.

In another embodiment, a portable diaper changing station can include a housing and a drawer. The housing can be defined by an exterior surface, have a housing top and a housing bottom spaced from the housing top by a height, and be sized to be carried by a user for use while away from home. The housing can include a baby changing surface at the housing top that is configured for receiving and supporting a baby during a diaper changing process. The housing can include a drawer cavity extending through the exterior surface of the housing into an interior of the housing and a drawer can be slidably positioned in the drawer cavity. The drawer can be sized to house diapers for use in changing the baby.

In another embodiment, a portable diaper changing station can include a housing and a plurality of housing feet. The housing can be defined by an exterior surface and have a housing top and a housing bottom spaced from the housing top by a height. The housing top can define a baby changing surface configured for receiving and supporting a baby during a diaper changing process. The housing can define one or more recesses. The housing feet can be sized to fit in the one or more recesses of the housing. The housing feet can be movable from a storage position in which the housing feet are stored in the one or more recesses of the housing and a supporting position in which the housing feet are positioned adjacent to the housing bottom for supporting the housing.

In another embodiment, a portable diaper changing station can include a platform structure having a top that defines a baby changing surface configured for receiving and supporting a baby during a diaper changing process. A support structure can be connected to and configured for supporting the platform structure. The support structure can be extendable from a storage position to a first extended position suitable for supporting the platform structure at a first height and a second extended position suitable for supporting the platform structure at a second height that is greater than the first height.

In another embodiment, a portable diaper changing station can include a baby changing surface configured for receiving and supporting a baby during a diaper changing process. A cover can be connected near an edge of the baby changing surface so as to be foldable between a closed position that at least partially covers the baby changing surface and an open position that exposes the baby changing surface. The cover can include at least one storage pocket.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
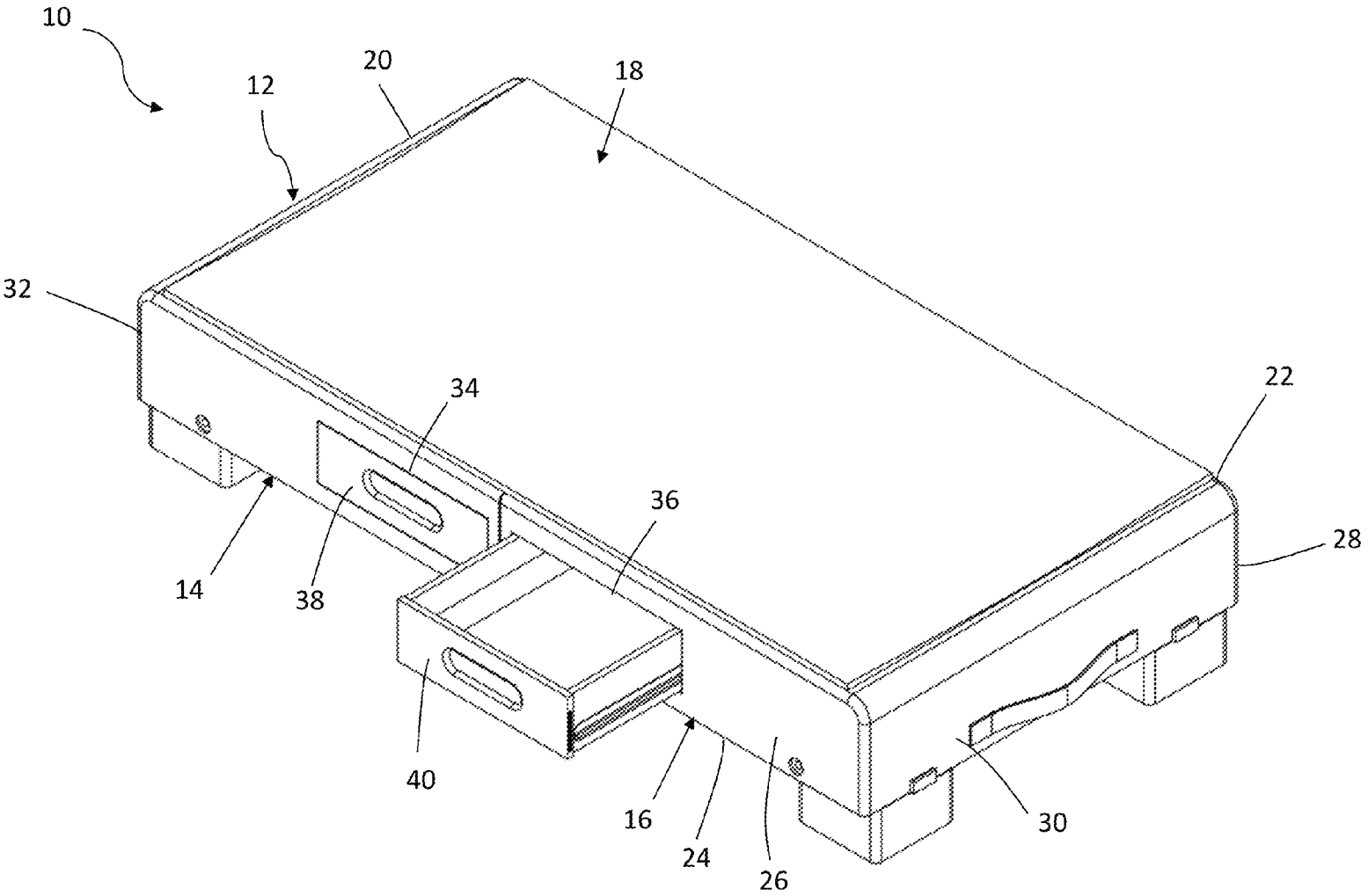
FIG. 1 is a perspective top view of a diaper changing station.

FIG. 1 is a perspective top view of a diaper changing station 10, which is a portable diaper changing station that includes a housing 12 having modules 14 and 16 and a pad 18. The housing 12 is a rigid structure defined by an exterior surface 20 and has a housing top 22, a housing bottom 24 opposite the housing top 22, a housing side 26, a housing side 28 opposite the housing side 26, a housing end 30, and a housing end 32 opposite the housing end 30.

The housing top 22 extends substantially from the housing end 30 to the housing end 32 and extends substantially from the housing side 26 to the housing side 28. The housing top 22 defines a baby changing surface configured for receiving and supporting a baby during a diaper changing process. In one embodiment, the baby changing surface defined by the housing top 22 can be substantially concave so as to retain the baby toward a center of the housing top 22 during the diaper changing process. In another embodiment, the baby changing surface defined by the housing top 22 can be substantially flat, in which case the pad 18 can be substantially concave so as to retain the baby toward a center of the pad 18. In further embodiments, both the housing top 22 and the pad 18 can be substantially flat or can have another shape suitable for the application.

In the illustrated embodiment, the diaper changing station 10 includes the pad 18 positioned on the housing top 22. The pad 18 is a baby changing pad and can be relatively soft for providing a cushioned surface for the baby to rest on during the baby changing process. In the illustrated embodiment, the pad 18 is a removable pad that can extend from the housing end 30 to the housing end 32 and can be removably attached to the housing top 22. In an alternative embodiment, the pad 18 can be integrally attached to the housing top 22.

The housing 12 defines drawer cavities 34 and 36. The drawer cavity 34 extends through the exterior surface 20 at the housing side 26 into an interior of the module 14. The drawer cavity 36 extends through the exterior surface 20 at the housing side 26 into an interior of the module 16. Drawers 38 and 40 are slidably positioned in the drawer cavities 34 and 36, respectively, so as to be openable and closable by a user. The drawers 38 and 40 are storage receptacles that can be sized and configured to house items used during the diaper changing process. In the illustrated embodiment, the drawers 38 and 40 are sized to house diapers and baby wipes. The housing top 22 is spaced from the housing bottom 24 by a distance that allows the drawer cavities 34 and 36 to be sized sufficiently to receive the drawers 38 and 40. In another embodiment, the drawers 38 and 40 can be sized to house diapers, baby wipes, baby clothing, and other baby-related items.

In the illustrated embodiment, the diaper changing station 10 includes two drawers 38 and 40 both extending into and accessible from the same housing side 26. In alternative embodiments, the drawers 38 and 40 can be positioned elsewhere, such as the drawer 38 extending from the housing end 32 and the drawer 40 extending from the housing end 30. In other alternative embodiments, there can be fewer than or greater than two drawers. For example, in one embodiment the diaper changing station 10 can include four drawers, including the drawers 38 and 40 substantially as illustrated as well as two additional drawers (not shown) extending into and accessible from the housing side 28 and positioned opposite and aligned with the drawers 38 and 40. In further alternative embodiments, the drawers 38 and 40 can be omitted and replaced by one or more alternative storage receptacles.

Figure 2:
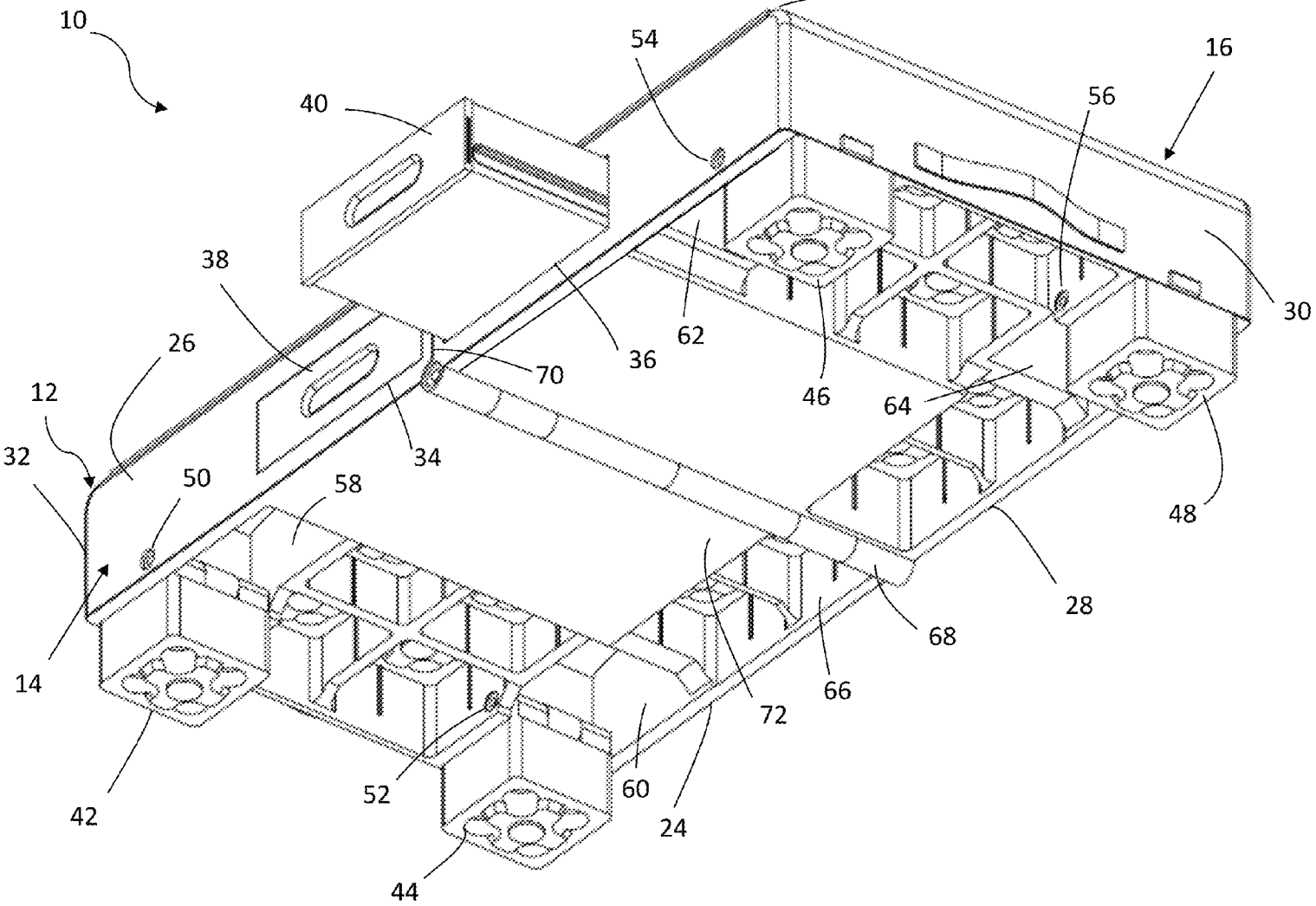
FIG. 2 is a perspective bottom view of the diaper changing station of FIG. 1.

FIG. 2 is a perspective bottom view of the diaper changing station 10. As shown in FIG. 2, the diaper changing station 10 includes housing feet 42, 44, 46, and 48 attached to the housing bottom 24. The housing feet 42, 44, 46, and 48 are positioned at corners of the housing 12 for supporting the housing 12 during the diaper changing process. The housing feet 42, 44, 46, and 48 can be movable from a storage position in which the housing feet 42, 44, 46, and 48 are stored to a supporting position in which the housing feet 42, 44, 46, and 48 are positioned adjacent the housing bottom 24 for supporting the housing 12. The housing feet 42, 44, 46, and 48 are in the supporting position as illustrated in FIG. 2.

In the illustrated embodiment, the housing feet 42, 44, 46, and 48 are hinged housing feet. The housing feet 42 and 44 are pivotably connected to the module 14 via hinges 50 and 52. The housing feet 46 and 48 are pivotably connected to the module 16 via hinges 54 and 56. The module 14 includes recesses 58 and 60 positioned adjacent the hinges 50 and 52 such that the housing feet 42 and 44 can be pivoted and stored in the recesses 58 and 60. The module 16 includes recesses 62 and 64 positioned adjacent the hinges 54 and 56 such that the housing feet 46 and 48 can be pivoted and stored in the recesses 62 and 64. The housing 12 can also include a plurality of additional recesses 66 for receiving and storing a plurality of foot extensions (not shown in FIG. 2). In the illustrated embodiment, the housing 12 includes twelve additional recesses 66 for storing twelve foot extensions. Including twelve foot extensions allows each of the four housing feet 42, 44, 46, and 48 to be extended three times. In some embodiments, the housing 12 can include fewer or more recesses 66 for storing less or more foot extensions.

In some embodiments, the housing feet 42, 44, 46, and 48 need not be hinged housing feet, but rather, can be otherwise movable from a storage position to a supporting position. For example, the housing feet 42, 44, 46, and 48 can have a snap-connection to the housing bottom 24 of the housing 12. In some cases, the housing feet 42, 44, 46, and 48 can be connected to the housing bottom 24 of the housing 12 via hook and loop fasteners, such as those commonly called VELCRO available from Velcro USA Inc. of Manchester N.H.

In some embodiments, the diaper changing station 10 can be formed primarily of polymer materials. For example, housing 12 including the modules 14 and 16, the drawers 38 and 40, and the feet 42, 44, 46, and 48 can each be formed of a polymer material via an injection molding process. The hinges 50, 52, 54, 56, and 68 can include metal (such as steel) rods about which the hinges 50, 52, 54, 56, and 68 pivot when the diaper changing station 10 is assembled. In other embodiments, the diaper changing station 10 can be formed of other materials and via other processes that are suitable for the application.

Figure 7:
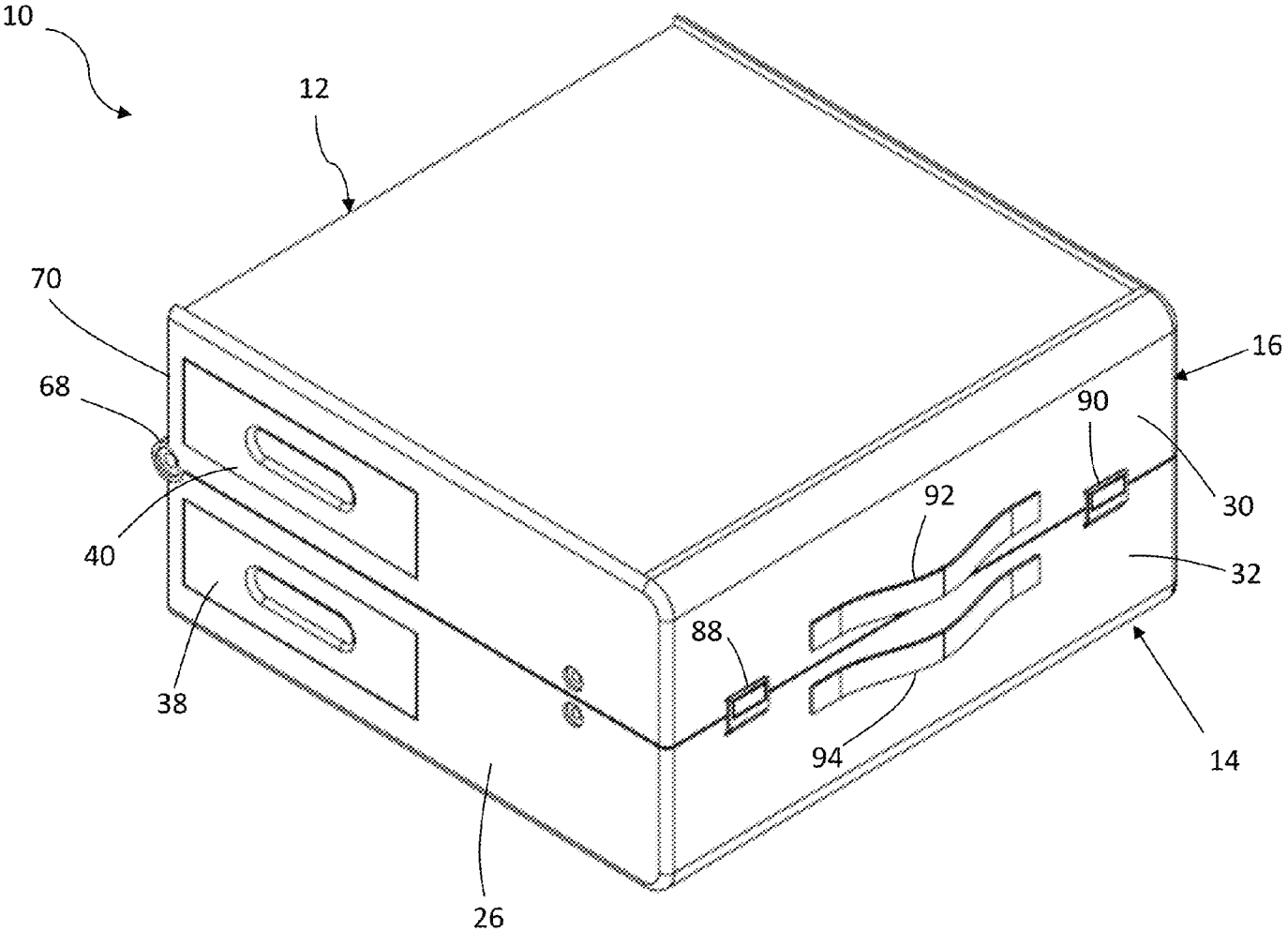
FIG. 7 is a perspective view of the diaper changing station of FIG. 1 with the diaper changing station in a folded position.

The housing 12 includes a hinge 68 that hingedly connects the module 14 to the module 16 so as to be movable from an open position (as illustrated in FIGS. 1 and 2) to a folded position (as illustrated in FIG. 7). The hinge 68 is positioned at a bottom edge of a division 70 between the module 14 and the module 16. The module 14 is aligned with the module 16 when in the open position such that the housing top 22 of the module 14 and the module 16 are aligned so as to be suitable for receiving and supporting the baby during the diaper changing process.

The housing 12 is foldable about the hinge 68, such that the housing 12 splits at the division 70 when in the folded position. The housing 12 can include a pad storage area 72 between the modules 14 and 16 for storage of the pad 18 (shown in FIG. 1). In one embodiment, the pad 18 can be folded and stored in the pad storage area 72 when the housing 12 is in the folded position.

Figure 3:
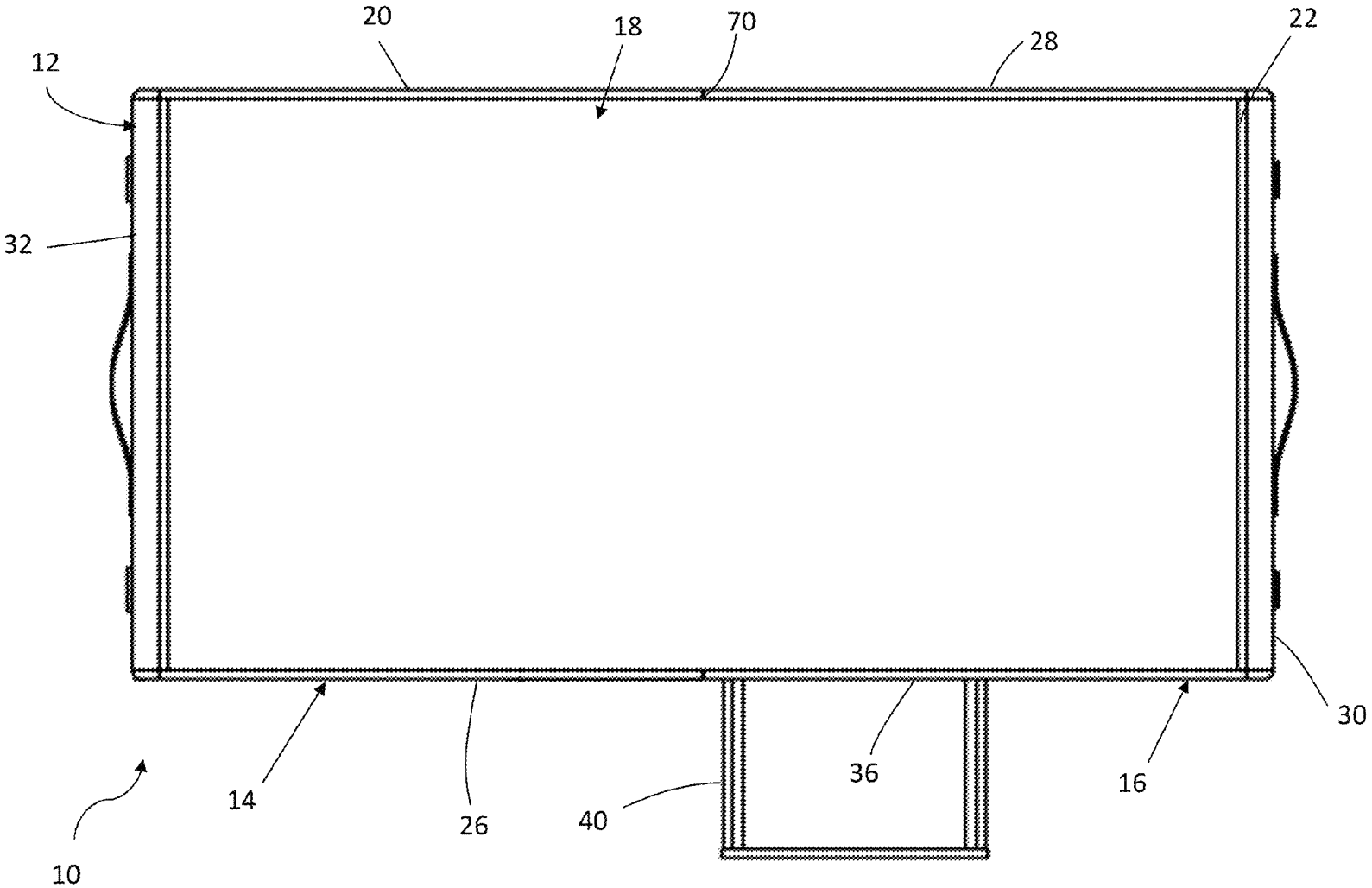
FIG. 3 is a top view of the diaper changing station of FIG. 1.

FIG. 3 is a top view of the diaper changing station 10. FIG. 3 is shown with the housing 12 in the open position, with the modules 14 and 16 folded open and aligned. The pad 18 is positioned on the housing 12 and substantially covers the housing top 22. The drawer 40 is slid open and the drawer 38 (not shown in FIG. 3) is slid closed.

In one embodiment, the housing 12 can have a width extending from the housing end 32 to the housing end 30 of about 32 inches (about 81 centimeters) and a depth from the housing side 26 to the housing side 28 of about 16.5 inches (about 42 centimeters). Each of the modules 14 and 16 can have a width that is approximately half of the width of the housing 12, extending from each of the respective housing ends 32 and 30 to the division 70. The pad 18 can have a width of about 30 inches (about 76 centimeters) and a depth of about 16 inches (about 41 centimeters). The drawer 40 can have a width of about 7.5 inches (about 19 centimeters) and a depth of about 12 inches (about 30 centimeters), although the drawer 40 is illustrated as extending only about 5 inches (about 13 centimeters) as shown in FIG. 3. In alternative embodiments, dimensions of the diaper changing station 10 can be modified as suitable for the application.

In some embodiments, the housing 12 can have a width extending from the housing end 32 to the housing end 30 of between about 24 to 34 inches (about 61 to 86 centimeters) and a depth from the housing side 26 to the housing side 28 of about 13 to 20 inches (about 33 to 51 centimeters). The pad 18 can have a width of about 22 to 34 inches (about 56 to 86 centimeters) and a depth of about 12 to 20 inches (about 30.5 to 51 centimeters). The drawer 40 can have a width of about 5 to 16 inches (about 13 to 41 centimeters) and a depth of about 6 to 20 inches (about 15 to 51 centimeters).

In some embodiments, the housing 12 can have a width extending from the housing end 32 to the housing end 30 of less than 34 inches (about 86 centimeters) and a depth from the housing side 26 to the housing side 28 of less than 20 inches (about 51 centimeters). The pad 18 can have a width of less than 34 inches (about 86 centimeters) and a depth of less than 20 inches (about 51 centimeters). The drawer 40 can have a width of less than 16 inches (about 41 centimeters) and a depth of less than 20 inches (about 51 centimeters).

Figure 4:
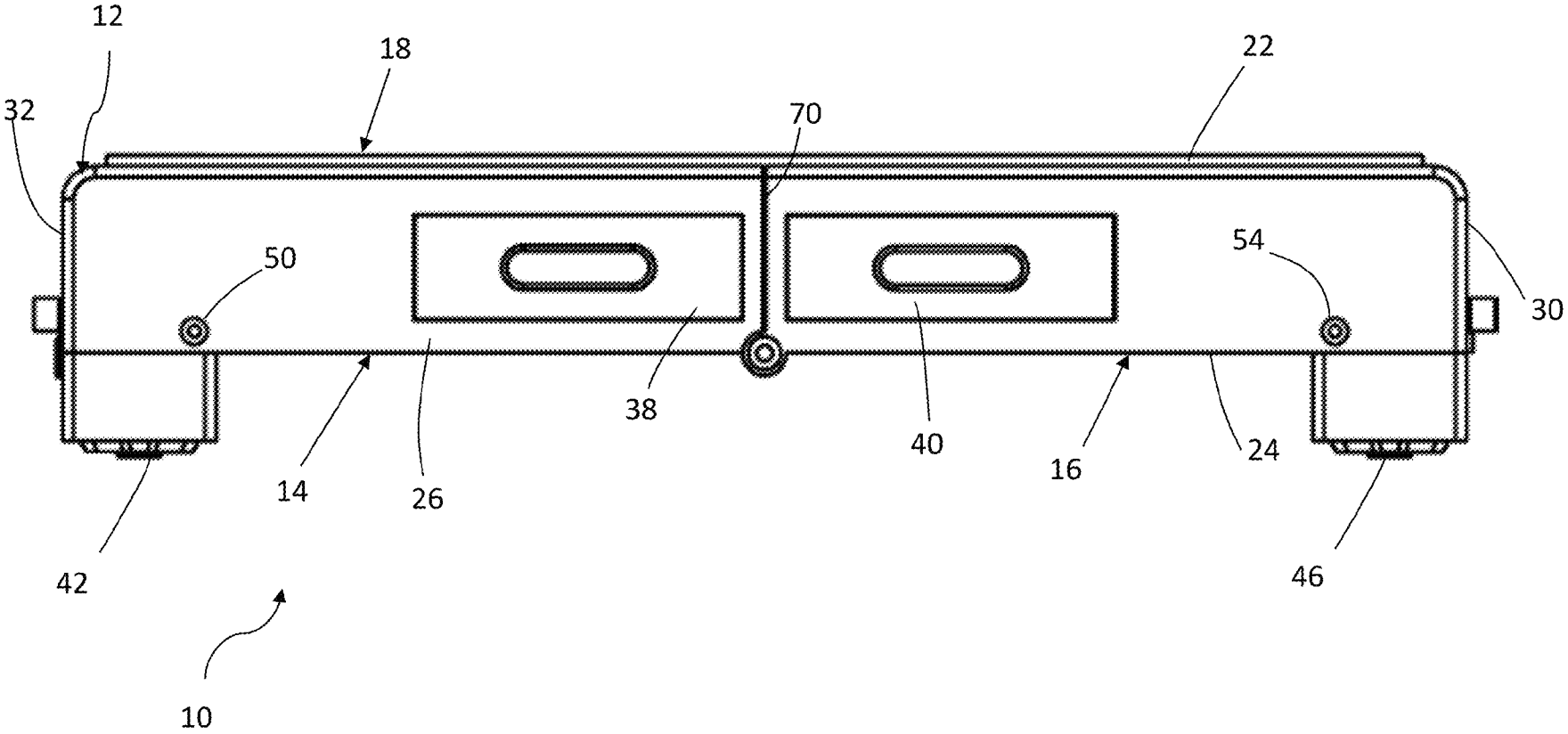
FIG. 4 is a side view of the diaper changing station of FIG. 1.

FIG. 4 is a side view of the diaper changing station 10. FIG. 4 is shown with the housing 12 in the open position, with the modules 14 and 16 folded open with the housing top 22 being aligned.

In one embodiment, the housing 12 can have a height (or thickness) extending from the housing top 22 to the housing bottom 24 of about 4 to 4.2 inches (about 10.2 to 10.7 centimeters). The housing feet 42 and 44 can each have a height of about 2.2 to 2.4 inches (about 5.6 to 6.1 centimeters). The height of the pad 18 can be about 1.5 inches (about 3.8 centimeters). When the housing feet 42 and 44 are in the supporting position, the combined height of the housing 12 with the housing feet 42 and 44 can be between about 6.2 to 6.6 inches (about 15.7 to 16.8 centimeters) and between about 7.7 and 8.1 inches (19.6 to 20.6 centimeters) when including the pad 18. This can allow the diaper changing station 10 to raise the baby to a height more comfortable to the user when performing the diaper changing process. The drawers 38 and 40 can each have a height of about 2.3 to 2.4 inches (about 5.8 to 6.1 centimeters), which is less than the height of the housing 12 and can be a suitable size for storing diapers, wipes, or other items. In alternative embodiments, dimensions of the diaper changing station 10 can be modified as suitable for the application.

In some embodiments, the housing 12 can have a height (or thickness) extending from the housing top 22 to the housing bottom 24 of about 2 to 6 inches (about 5 to 15 centimeters). The housing feet 42 and 44 can each have a height of about 1 to 6 inches (about 2.5 to 15 centimeters). The height of the pad 18 can be about 0.2 to 2 inches (about 0.5 to 5 centimeters). The drawers 38 and 40 can each have a height of about 1 to 5 inches (about 2.5 to 13 centimeters).

In some embodiments, the housing 12 can have a height (or thickness) extending from the housing top 22 to the housing bottom 24 of greater than 1 inch (about 2.5 centimeters). The housing feet 42 and 44 can each have a height of greater than 1 inch (about 2.5 centimeters). The height of the pad 18 can be less than 2 inches (about 5 centimeters). The drawers 38 and 40 can each have a height of less than 3 inches (about 7.6 centimeters).

Figure 5:
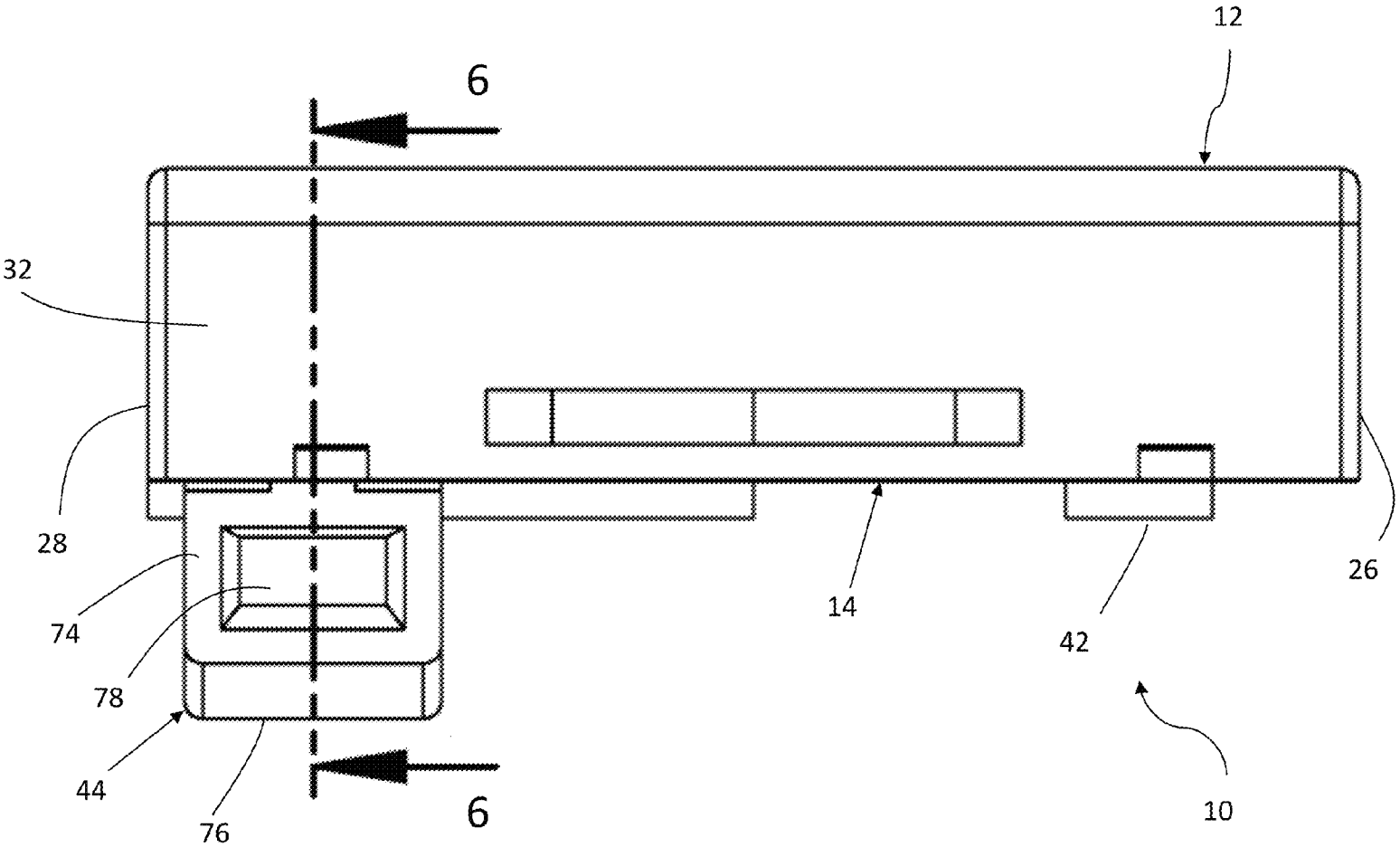
FIG. 5 is an end view of the diaper changing station of FIG. 1.

FIG. 5 is an end view of the diaper changing station 10. As shown in FIG. 5, the foot 42 is in the storage position and the foot 44 is rotated to a position between the storage position and the supporting position. The foot 44 has a top 74 and a bottom 76. The foot 44 includes a projection 78 extending from the top 74 of the foot 44.

Figure 6:
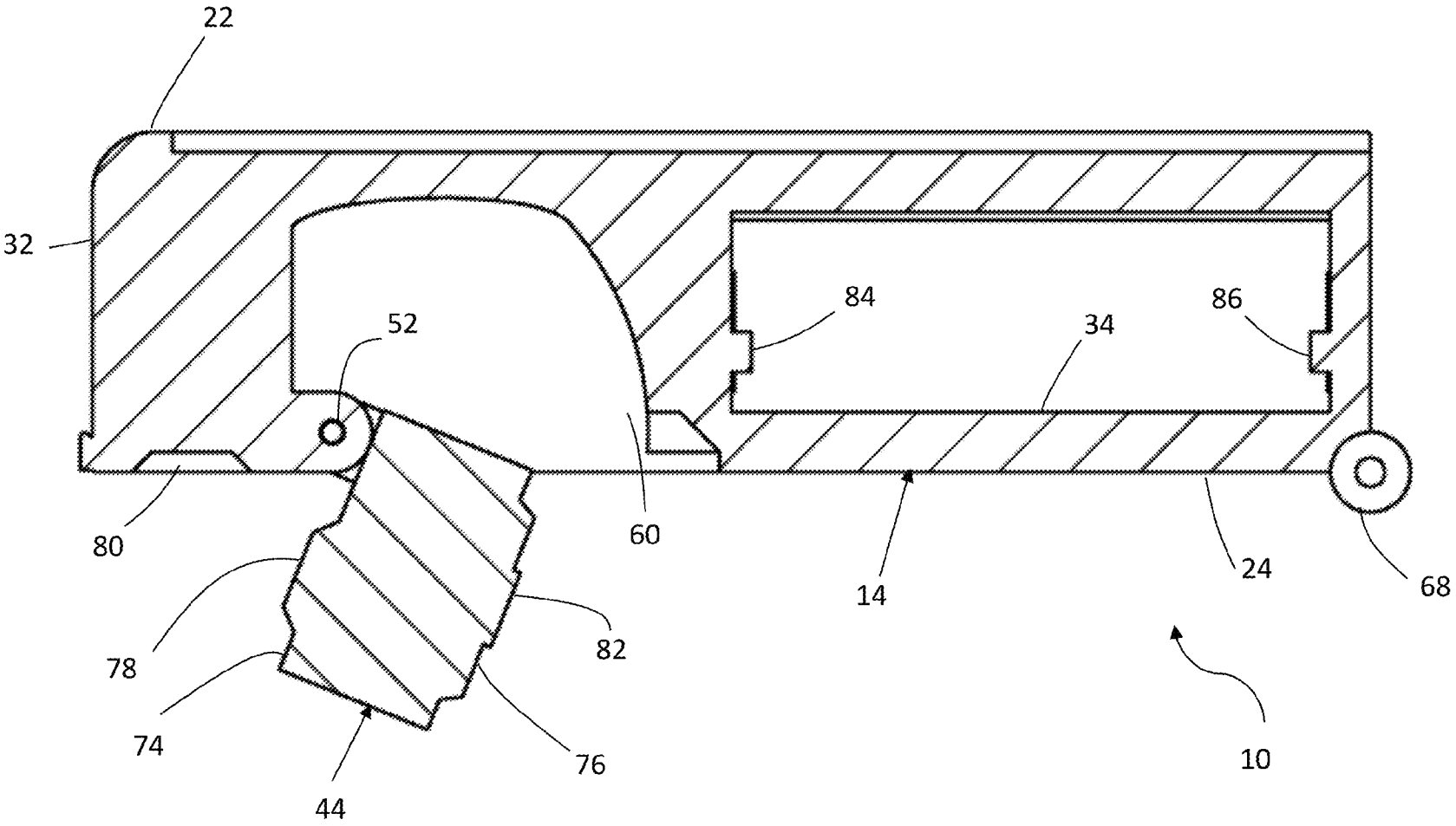
FIG. 6 is a sectional view of a module of the diaper changing station taken along line 6-6 of FIG. 5.

FIG. 6 is a sectional view of the module 14 of the diaper changing station 10 taken along line 6-6 of FIG. 5. The sectional view of FIG. 6 cuts through the foot 44 and the corresponding recess 60 to better illustrate how the foot 44 pivots about the hinge 52 from the storage position to the supporting position. The housing bottom 24 of the module 14 includes a cavity 80 aligned with the projection 78 on the top 74 of the foot 44. The cavity 80 can receive the projection 78 when the foot 44 is pivoted to the supporting position. The bottom 76 of the foot 44 includes a pad 82 configured to rest on a surface (such as a trunk of a vehicle, a table, or the ground) for supporting the changing station 10. In one embodiment, the pad 82 can be a rubber pad attached to the bottom 76 of the foot 44 via adhesive. In another embodiment, the pad 82 can be a felt pad attached to the bottom 76 of the foot 44 via adhesive. In a further embodiment, the pad 82 can be integrally formed with the foot 44, for example, via an injection molding process.

The drawer 38 (not shown in FIG. 6) has been removed from FIG. 6 to show the drawer cavity 34, which is defined by the module 14. The module 14 includes rails 84 and 86 that extend into the drawer cavity 34. The rails 84 and 86 can support and guide the drawer 38 as it is slid into and out of the drawer cavity 34.

FIG. 7 is a perspective view of the diaper changing station 10 in the folded position. The module 14 is parallel to and abutting the module 16 with the housing bottom 24 of the modules 14 and 16 in abutting contact when the diaper changing station 10 is in the folded position. The pad 18 (shown in FIGS. 1, 3, and 4) can be folded and stored between the modules 14 and 16 when the diaper changing station 10 is in the folded position.

The diaper changing station 10 can include one or more latches 88 and 90 that latch the housing end 30 of the module 16 to the housing end 32 of the module 14 when the diaper changing station 10 is in the folded position. The diaper changing station 10 can include one or more handles 92 and 94 positioned on the housing ends 30 and 32 for carrying the diaper changing station 10 when the diaper changing station 10 is in the folded position.

Figure 8:
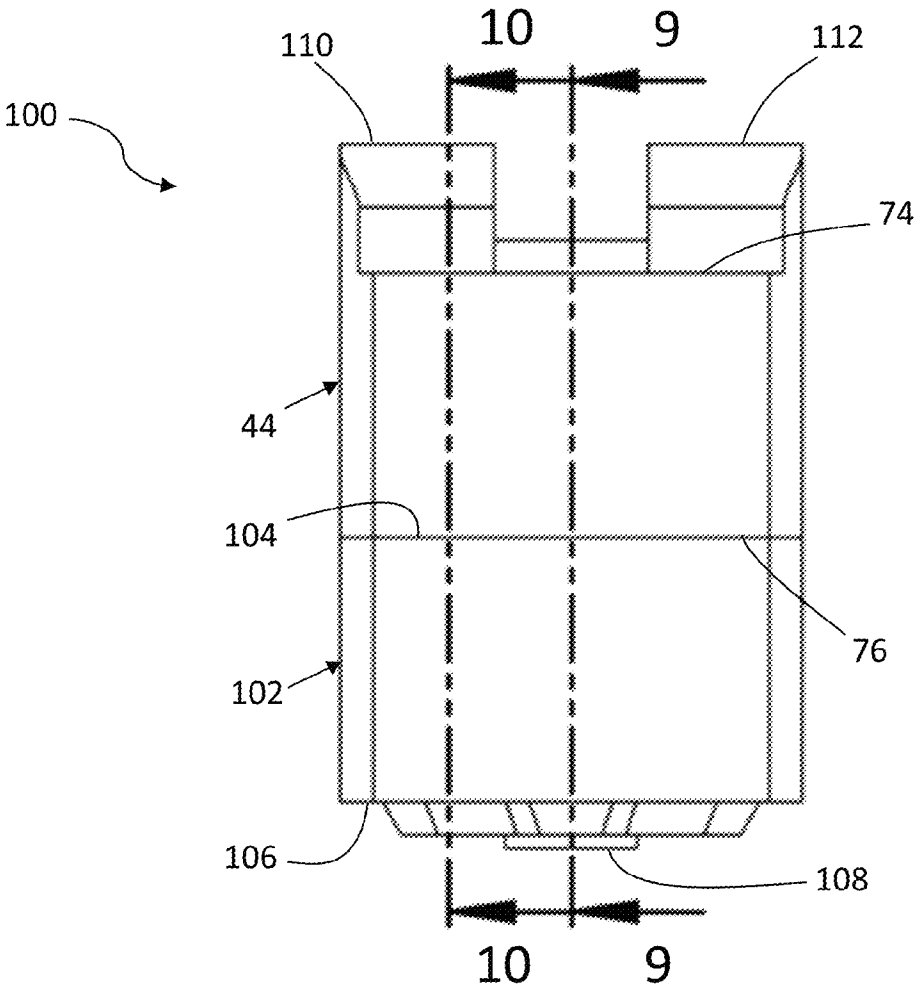
FIG. 8 is a side view of a foot assembly for use with the diaper changing station of FIG. 1.

FIG. 8 is a side view of a foot assembly 100 for use with the diaper changing station 10 (shown in FIGS. 1-7). The foot assembly 100 includes the foot 44 and an extension 102. The extension 102 includes a top 104 and a bottom 106. The extension 102 connects to the foot 44 with the top 104 of the extension 102 abutting the bottom 76 of the foot 44, thus effectively extending the foot 44 by a length equal to a height of the extension 102. The extension 102 has a pad 108 on the bottom 106 of the extension 102. The pad 108 can be substantially similar to the pad 82, described with respect to FIG. 6.

The foot 44 includes hinge knuckles 110 and 112 extending from the top 74 of the foot 44. The hinge knuckles 110 and 112 form part of the hinge 52 (shown in FIGS. 2 and 6) and can pivot about a pin (not shown in FIG. 8) of the hinge 52.

Figure 9:
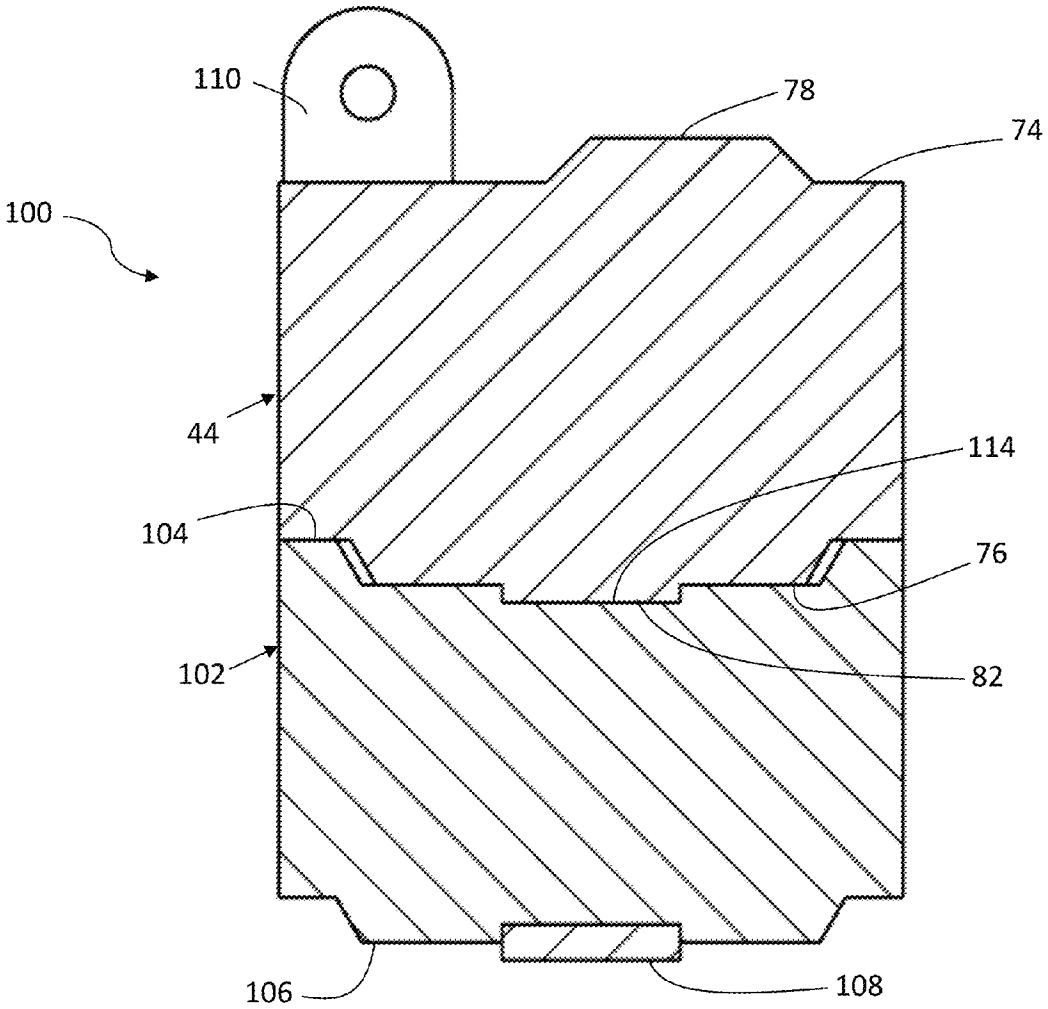
FIG. 9 is a sectional view of the foot assembly taken along line 9-9 of FIG. 8.

FIG. 9 is a sectional view of the foot assembly 100 taken along line 9-9 of FIG. 8. The top 104 of the extension 102 includes a cavity 114 sized and shaped to receive the pad 82 on the bottom 76 of the foot 44.

Figure 10:
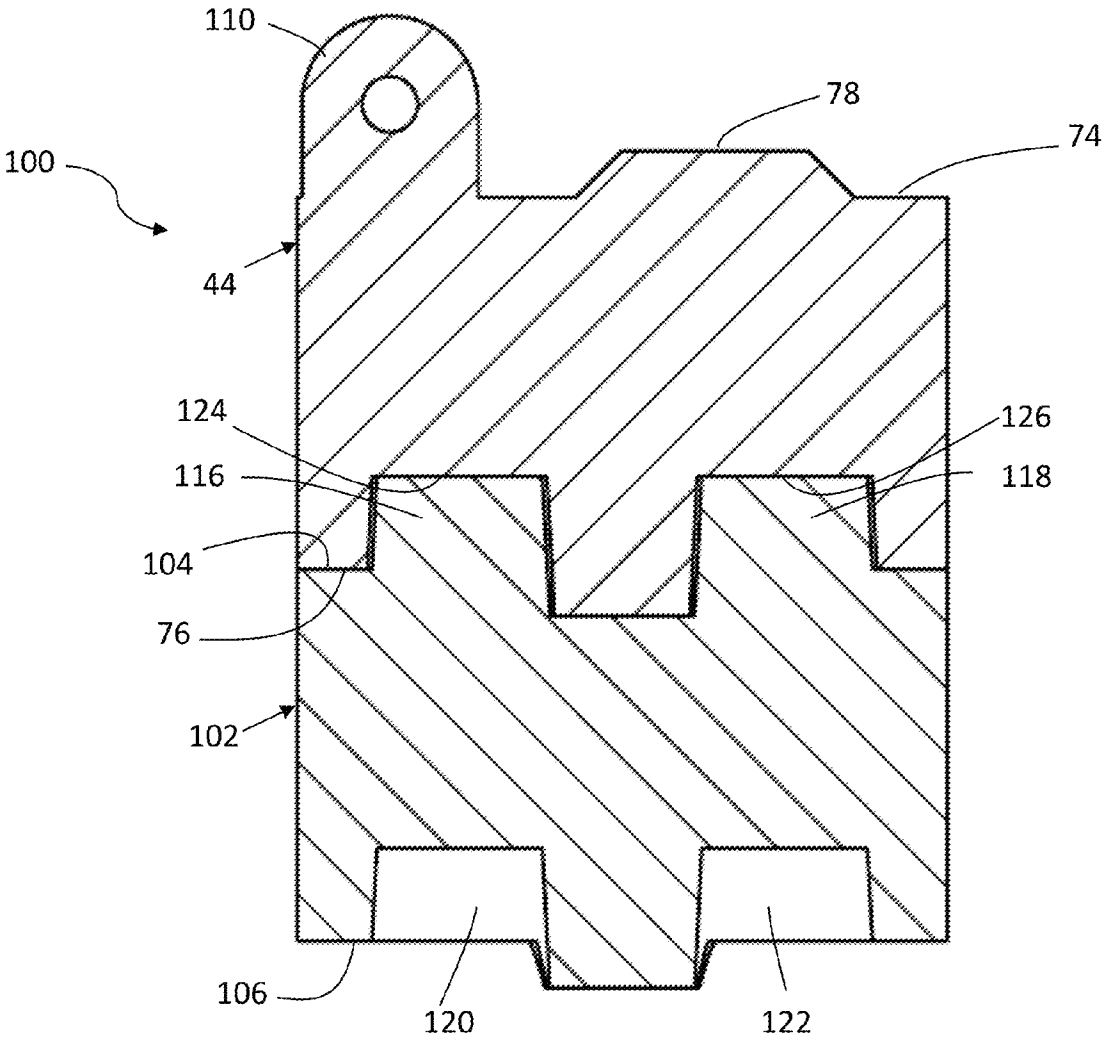
FIG. 10 is a sectional view of the foot assembly taken along line 10-10 of FIG. 8.

FIG. 10 is a sectional view of the foot assembly 100 taken along line 10-10 of FIG. 8. The extension 102 includes prongs 116 and 118 extending from the top 104 of the extension 102 and includes sockets 120 and 122 recessed in the bottom 106 of the extension 102. The foot 44 also includes sockets 124 and 126 recessed in the bottom 76 of the foot 44. The sockets 124 and 126 can be sized and shaped similar to the sockets 120 and 122. The prongs 116 and 118 can be sized and shaped complementary to the sockets 120, 122, 124 and 126. As illustrated in FIG. 10, the prongs 116 and 118 are positioned in the sockets 124 and 126 in a snap-fit relationship. The top 104 of the extension 102 is sized and shaped complementary to the bottom 76 of the foot 44 such that the extension 102 can have a snap-fit connection to the foot 44. The top 104 of the extensions 102 can also be sized and shaped to have a snap-fit connection with the housing 12 when the extensions 102 are placed in the recesses 66 for storage.

The bottom 106 of the extension 102 can be sized and shaped similar to the bottom 76 of the foot 44. This allows for additional extensions (not shown in FIG. 10) that are sized and shaped similar to the extension 102 to be snapped and connected to the bottom 106 of the extension 102. This allows a user to adjust the height of the foot assembly 100 by connecting more or fewer extensions 102 to achieve a desired height of the diaper changing station 10 (shown in FIGS. 1-7). Bottoms of the housing feet 42, 46, and 48 can be sized and shaped similar to the bottom 76 of the foot 44, such that extensions 102 can similarly be connected to the other housing feet 42, 46, and 48 to adjust the effective height of the diaper changing station 10.

Figure 11:
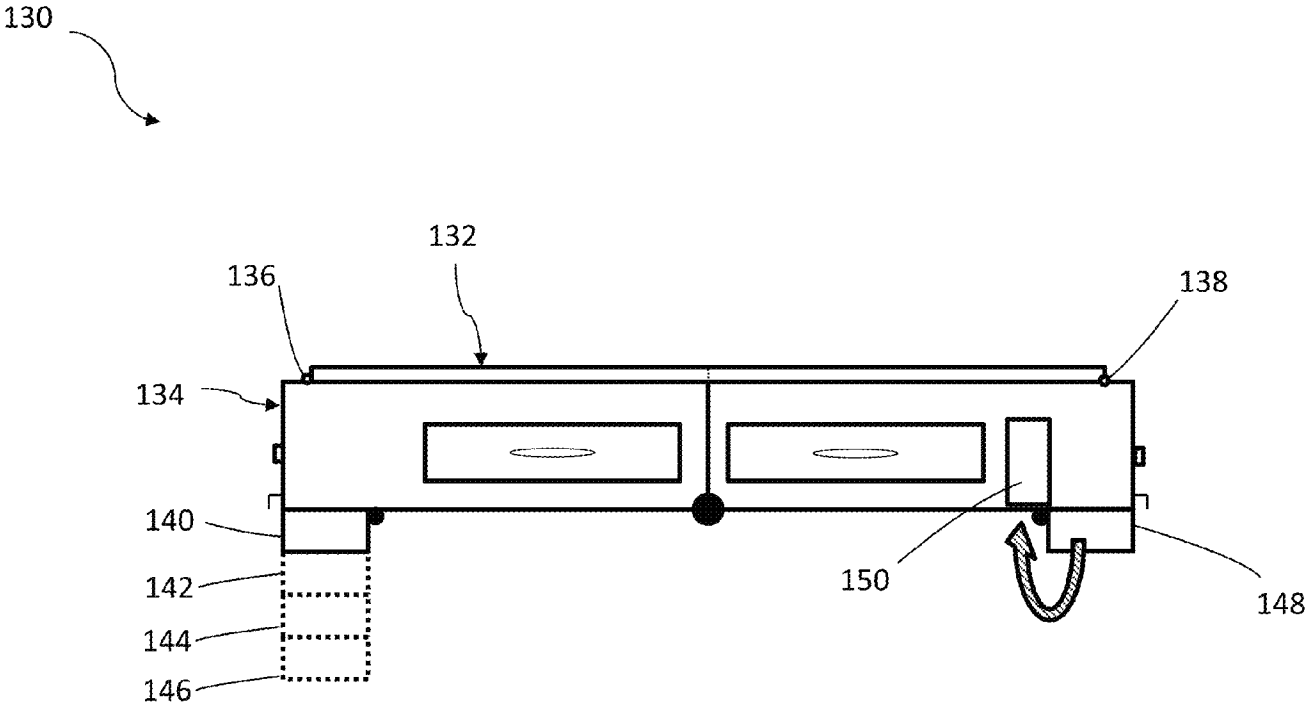
FIG. 11 is a side schematic view of an alternative embodiment of a diaper changing station.

FIG. 11 is a side schematic view of a diaper changing station 130, which can be similar to the diaper changing station 10 (shown in FIGS. 1-7). The diaper changing station 130 includes a pad 132 attached to a housing 134 via fasteners 136 and 138. The fasteners 136 and 138 can allow the pad 132 to be attached and detached to a top of the housing 134, which can facilitate both use and storage of the pad 132. In one embodiment, fasteners 136 and 138 can be snap connectors. In another embodiment, the fasteners 136 and 138 can be hook and loop fasteners.

The diaper changing station 130 includes a housing foot 140 in a supporting position, with a set of extensions 142, 144, and 146 attached in series to and extending from a bottom of the housing foot 140. Use of the extensions 142, 144, and 146 can increase the effective height of the diaper changing station 130 to increase user convenience and comfort. For example, increasing the effective height of the diaper changing station 130 can reduce or prevent a user from having to bend his or her back during the diaper changing process and consequently reduce or prevent back strain. The diaper changing station also includes a housing foot 148, which is shown being pivoted from a supporting position to a storage position in a recess 150. A set of extensions, such as the extensions 142, 144, and 146, can also be attached to the housing foot 148 to increase the effective height of the diaper changing station 130.

In some embodiments, the extensions 142, 144, and 146 can each have a height of about 1 to 3 inches (about 2.5 to 7.5 centimeters). In some embodiments, the extensions 142, 144, and 146 can each have a height of about 1 to 2 inches (about 2.5 to 5 centimeters). In some embodiments, the extensions 142, 144, and 146 can each have a height of about 2 to 3 inches (about 5 to 7.5 centimeters). In some embodiments, the extensions 142, 144, and 146 can each have a height of about 1.5 to 2.5 inches (about 3.8 to 6.3 centimeters). In one embodiment, the extensions 142, 144, and 146 can each have a height of about 2 inches (about 5 centimeters). Thus, the user can increase the effective height of the diaper changing station 130 in 2 inch increments by adding one, two, three, or more extensions 142, 144, and 146 to the feet 140 and 148.

Accordingly, various embodiments of the diaper changing stations described above can provide a relatively sturdy and convenient diaper changing station suitable for use both at home and when traveling. Including a rigid housing can help provide a sturdy structure for supporting a baby during a diaper changing process. Including drawers or other storage receptacles allows a user to store diapers and wipes for use during the diaper changing process. Including feet and extensions allows for adjustability of the diaper changing station to a height desirable by a user, which can vary depending on the height of the user, the location of use, and user preferences. The inter-connectablity of the feet and extensions described above allows for adjustable foot assemblies that are both sturdy and convenient. Including recesses in the housing for storage of feet and feet-extensions allows for a convenient and secure storage location of the feet and extensions when not in use. Including a removable pad can allow the diaper changing station to have a cushioned surface for the baby that is also removable and storable within the housing. Designing the housing to have first and second pivotably connected modules allows the housing to be folded and stored with a relatively small footprint. The housing can be sized and configured to include space for drawers and recesses for feet and extensions, allowing the diaper changing station to be a relatively self-contained unit. Various embodiments of diaper changing stations can include one, more, or all of these features as deemed appropriate for a given application.

In one embodiment, a diaper changing station can be designed for the trunk of a car (or any flat but low surface). The diaper changing station can be built from thick sturdy plastic with a hinge half-way through for easy folding, as well as thick sturdy blocks that can fit under each foot to change the elevation of the changing table as needed. A cushioned cover can attach easily via snaps or VELCRO to provide a clean changing area for the baby. The main platform can also have a drawer for storing wipes, diapers, etc. The blocks can be stored inside the folded platform.

Figure 12:
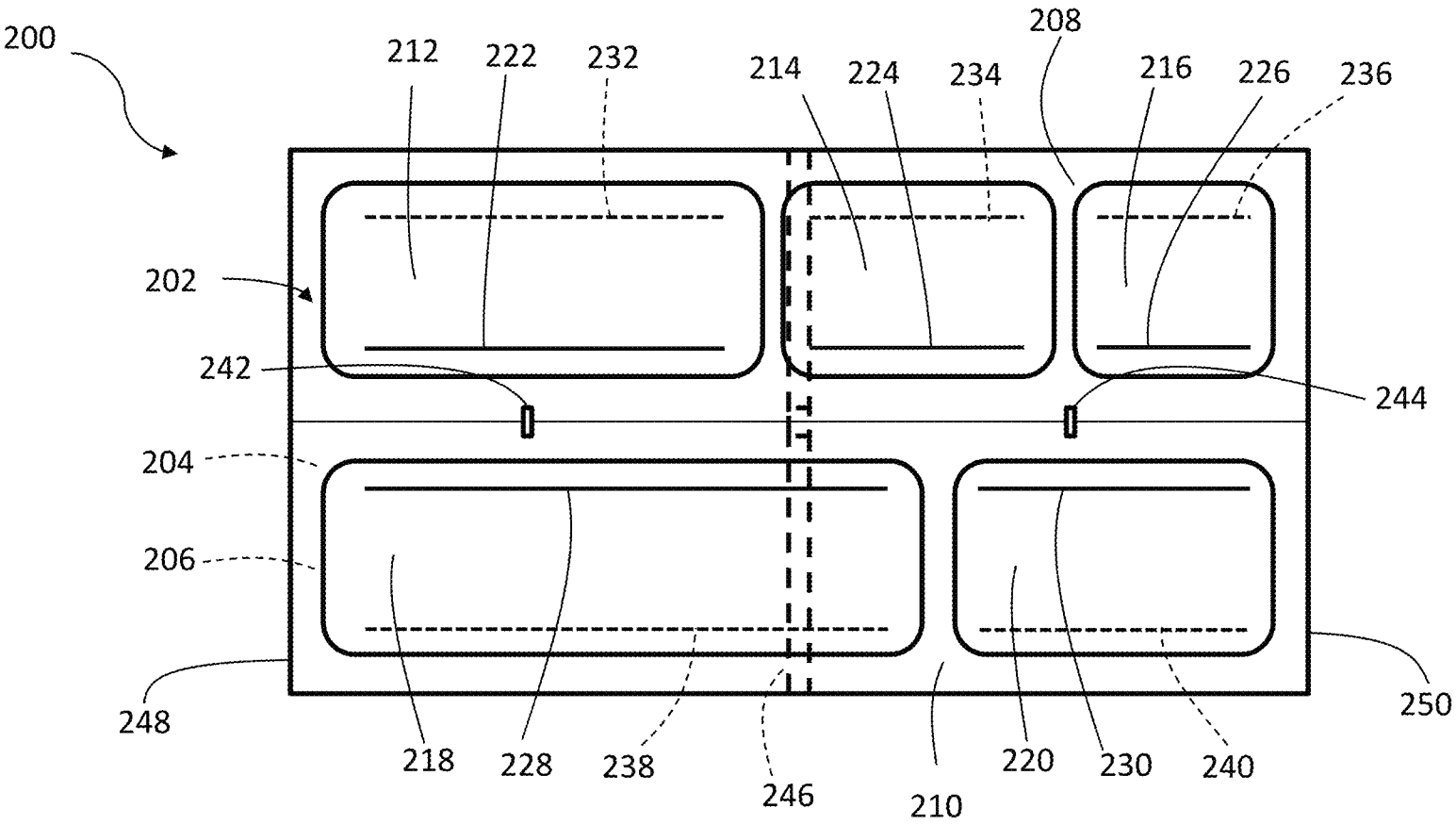
FIG. 12 is a top view of an alternative embodiment of a diaper changing station.

FIG. 12 is a top view of a diaper changing station 200, which is an alternative embodiment of the diaper changing stations described above. FIG. 12 shows the diaper changing station 200 having a cover 202 that can cover a pad 204 and a platform 206. The cover 202 can include one or more flaps 208 and 210. The cover 202 can include one or more storage pockets 212, 214, 216, 218, 220 on the flaps 208 and 210. In the illustrated embodiment, the flap 208 includes three storage pockets 212, 214, and 216 and the flap 210 includes two storage pockets 218 and 220, with the storage pocket 218, 220, and 212 being larger than the storage pockets 214 and 216. In other embodiments, the cover 202 can include storage pockets that are sized, positioned, and numbered differently than as illustrated.

The storage pockets 212, 214, 216, 218, 220 can include openings 222, 224, 226, 228, 230 and openings 232, 234, 236, 238, 240, respectively. In the illustrated embodiment, the openings 222, 224, 226, 228, 230 are positioned on a top of the storage pockets 212, 214, 216, 218, 220 and are accessible from a top of the diaper changing station 200 when the cover 202 is closed. The openings 232, 234, 236, 238, 240 are positioned on a bottom of the storage pockets 212, 214, 216, 218, 220 and are accessible from the diaper changing station 200 when the cover 202 is opened. In some embodiments, the openings 222, 224, 226, 228, 230 and the openings 232, 234, 236, 238, 240 can be zippered openings, including zipper fasteners for opening and closing the openings 222, 224, 226, 228, 230 and the openings 232, 234, 236, 238, 240. In some embodiments, the openings 222, 224, 226, 228, 230 and the openings 232, 234, 236, 238, 240 can include one or more other fasteners for opening and closing the openings 222, 224, 226, 228, 230 and the openings 232, 234, 236, 238, 240. Such fasteners can include snaps, buttons, and/or hook and loop fasteners commonly called VELCRO available from Velcro USA Inc. of Manchester N.H.

The cover 202 can include one or more cover fasteners 242 and 244 for retaining the cover 202 in a closed position, as illustrated in FIG. 12. In the illustrated embodiment, the cover fasteners 242 and 244 connect the flap 208 to the flap 210. In some embodiments the cover fasteners 242 and 244 can be VELCRO hook and loop fasteners. In some embodiments, the cover fasteners 242 and 244 can include buttons, snaps, or other fasteners suitable for the application.

The diaper changing station 200 can include a strap 246 extending across the pad 204. The strap 246 can be a safety strap for holding a baby in place on the pad 204 while changing the baby. The strap 246 is positioned between the cover 202 and the pad 204 when the cover 202 is closed. The strap 246 and the pad 204 are exposed, allowing access to the strap 246 and the pad 204, when the cover 202 is opened.

The cover 202, the pad 204, and the platform 206 can each extend substantially the length of the diaper changing station 200, from an end 248 to an end 250. The end 248 can be a head end and the end 250 can be a foot end at longitudinally opposite ends of the diaper changing station 200. The cover 202 can substantially cover a top of the pad 204 to protect the pad 204 when not in use.

Figure 13:
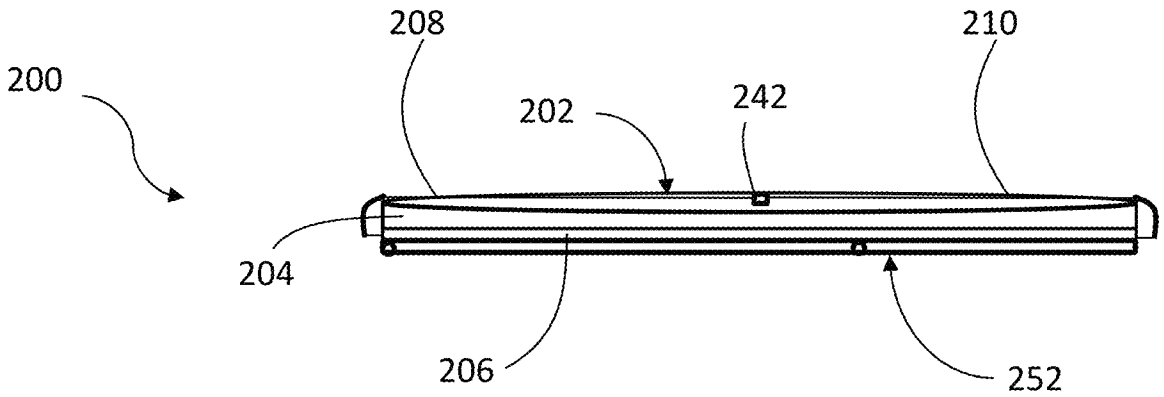
FIG. 13 is an end view of the diaper changing station of FIG. 12.

FIG. 13 is an end view of the diaper changing station 200 as viewed from the end 248 (shown in FIG. 12). FIG. 13 illustrates the cover 202 being positioned above the pad 204, which is poisoned above the platform 206. An adjustable support system 252 is positioned below and connected to the platform 206 for supporting the platform 206. The adjustable support system 252 can be adjusted to multiple heights for supporting the diaper changing station 200 at different heights as selected by a user. As illustrated in FIG. 13, the adjustable support system 252 is shown in a storage position, with the adjustable support system 252 collapsed. In the storage position, the diaper changing station can be relatively thin from a top of the cover 202 to a bottom of the support system 252. For example, in some embodiments, the diaper changing station 200 can have a height of about 2 inches in a storage position. In some embodiments, the diaper changing station 200 can have a height of between about 1.5 inches to about 2.5 inches in a storage position. In some embodiments, the diaper changing station 200 can have a height of between about 1 inch to about 4 inches in a storage position. In some embodiments, the diaper changing station 200 can be sized and shaped differently than as illustrated as suitable for the application. The adjustable support system 252 can be adjusted to raise an effective height of the diaper changing station 200.

Figure 14:
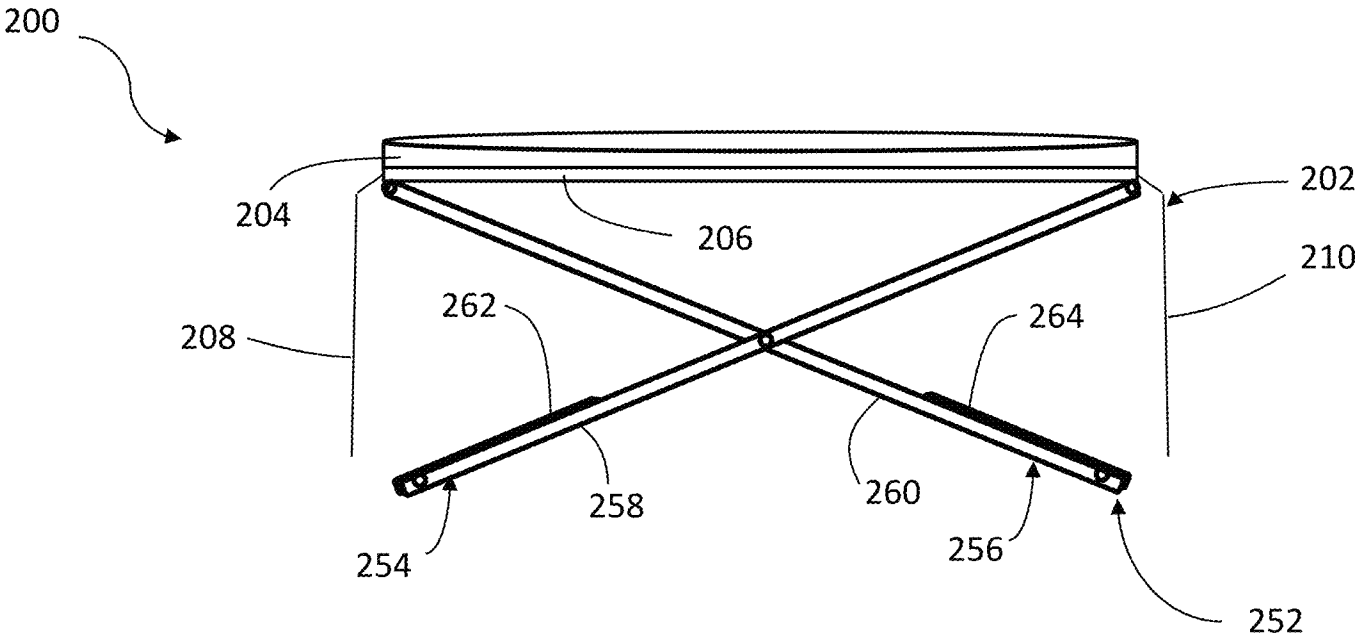
FIG. 14 is an end view of the diaper changing station of FIG. 12 with legs extended to a first height.

FIG. 14 is an end view of the diaper changing station 200 with the adjustable support system 252 extended to a first height. The cover 202 of the diaper changing station 200 is also opened so as to expose a top of the pad 204. The flaps 208 and 210 can fold open and hang downward from edges of the platform 206. The pad 204 can define a baby changing surface at a top of the pad that can be configured for cradling a baby during a diaper changing process. In some embodiments, a top surface of the platform 206 can be substantially flat and the baby changing surface defined by the pad 204 can be substantially concave so as to retain the baby toward a center of pad 204 during the diaper changing process. In another embodiment, the pad 204 can be omitted and the platform 206 can define a concave baby changing surface so as to retain the baby toward a center of the platform 206. The baby changing surface can be concave in one direction (such as from side to side) or can be concave in multiple directions (such as from side to side and from head to foot). In some embodiments the pad 204 can be removably connected to the platform 206. In other embodiments, the pad 204 can be integrally connected to or integrally formed with the platform 206.

In some embodiments, the adjustable support system 252 can be an adjustable leg system including legs 254 and 256. The legs 254 and 256 can be adjustable legs, each with multiple leg segments 258, 260, 262, and 264. The leg segment 258 can be pivotably connected to the platform 206 at an edge near the flap 210. The leg segment 260 can be pivotably connected to the platform 206 at an edge near the flap 208 and opposite of the edge near the flap 210. The leg segment 260 can be pivotably connected to the leg segment 258 at or near the middles of the leg segments 258 and 260 so as to create an "X" shape that supports the diaper changing station 200 at the first height. The legs 252 and 256 can be pivoted so as to extend from a folded, storage position (as illustrated in FIG. 13) to an extended, first height position. In some embodiments, at least part of the adjustable support system 252 can be detachably connectable to the platform 206. For example, at least one of the leg segments 258 and 260 can be detachably connected to an edge of the platform 206. In one example, a top end of the leg segment 260 can detach from the platform 206 to switch from the first height position to the storage position and can subsequently reattach to the platform 206 to switch from the storage position to the first height position.

Figure 15:
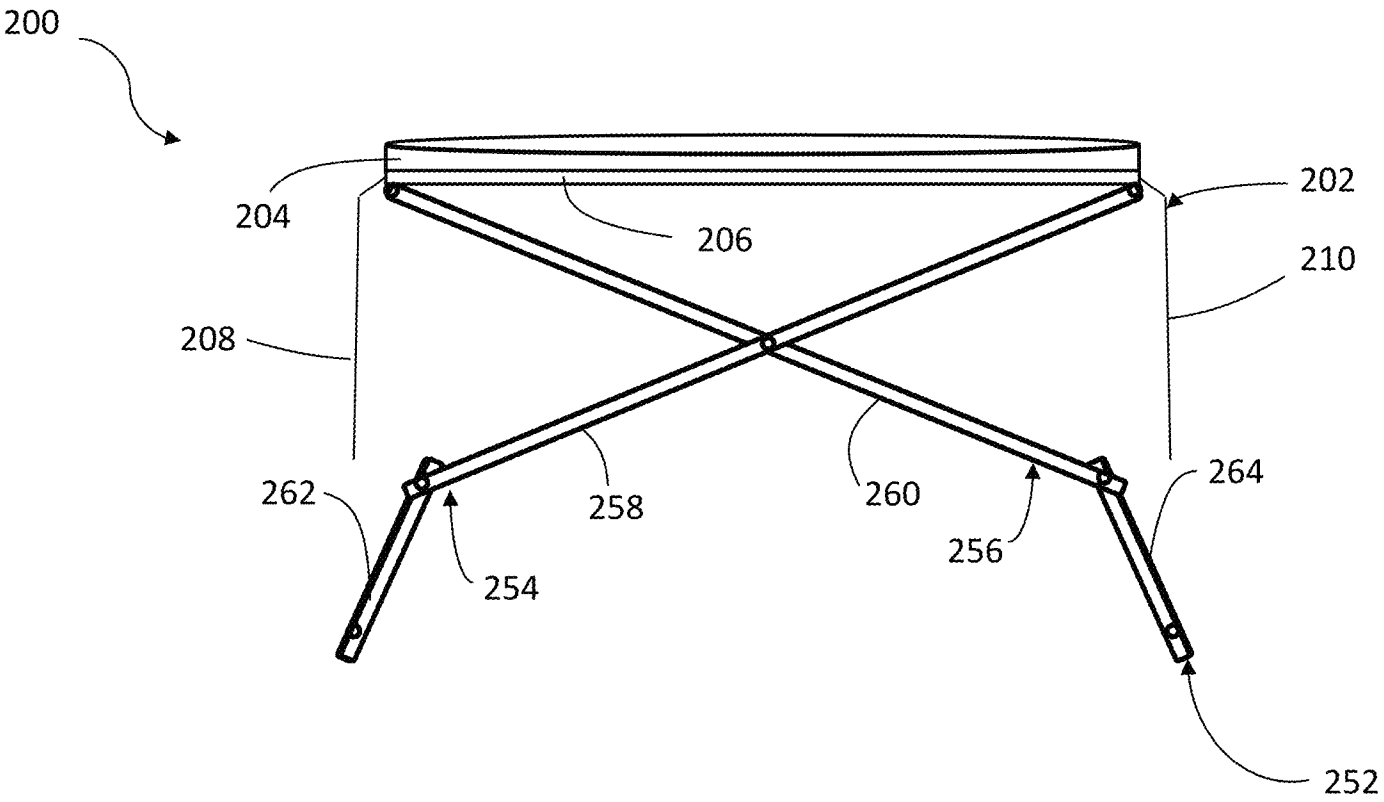
FIG. 15 is an end view of the diaper changing station of FIG. 12 with legs extended to a second height.

The leg segment 262 can be pivotably connected to a bottom end of the leg segment 258. The leg segment 262 can be pivoted from a folded, storage position (as illustrated in FIG. 14) to an extended position (as illustrated in FIG. 15). The leg segment 264 can be pivotably connected to a bottom end of the leg segment 260. The leg segment 264 can be pivoted from a folded, storage position (as illustrated in FIG. 14) to an extended position (as illustrated in FIG. 15). When the adjustable support system 252 is extended to the first height, the leg segments 262 and 264 can be stored in a manner such that they do not substantially contribute to the extended support of the diaper changing station 200.

In some embodiments, the first height of the diaper changing station 200 can be about 12 inches. In some embodiments, the first height of the diaper changing station 200 can be between about 5 inches and about 20 inches.

FIG. 15 is an end view of the diaper changing station 200 with the adjustable support system 252 extended to a second height. At the second height, the leg segments 262 and 264 can be pivoted and extended to raise and support the diaper changing station 200 at the second height. The leg segments 262 and 264 can be locked in place to support the diaper changing station at the second height. In some embodiments, the second height of the diaper changing station 200 can be about 24 inches. In some embodiments, the third height of the diaper changing station 200 can be between about 14 inches and about 30 inches.

Figure 16:
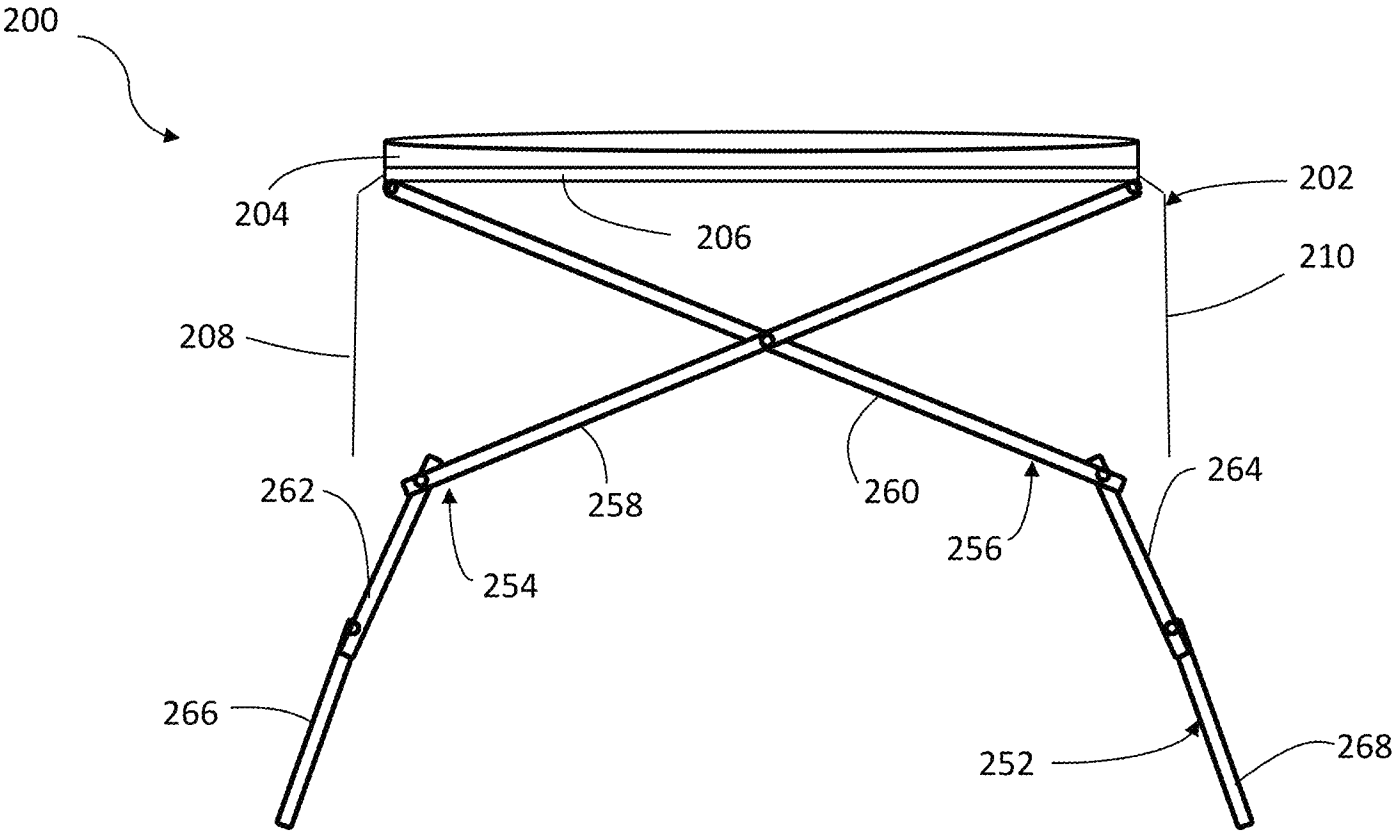
FIG. 16 is an end view of the diaper changing station of FIG. 12 with legs extended to a third height.

FIG. 16 is an end view of the diaper changing station 200 with the adjustable support system 252 extended to a third height. The leg segment 266 can be pivotably connected to a bottom end of the leg segment 262. The leg segment 266 can be pivoted from a folded, storage position to an extended position (as illustrated in FIG. 16). The leg segment 268 can be pivotably connected to a bottom end of the leg segment 264. The leg segment 268 can be pivoted from a folded, storage position to an extended position (as illustrated in FIG. 16).

When the adjustable support system 252 is extended to the first and second heights, the leg segments 266 and 268 can be stored in a manner such that they do not substantially contribute to the extended support of the diaper changing station 200. When the adjustable support system 252 is extended to the third height, the leg segments 266 and 268 can be pivoted and extended to raise and support the diaper changing station 200 at the third height. The leg segments 262, 264, 266, and 268 can be locked in place to support the diaper changing station at the third height. In some embodiments, the third height of the diaper changing station 200 can be about 36 inches. In some embodiments, the third height of the diaper changing station 200 can be between about 20 inches and about 48 inches.

The diaper changing station 200 can adjust between multiple heights, including a relatively thin storage height and three raised heights: the first height, the second height, and the third height. This can allow a user to use the diaper changing station 200 on a variety of surfaces such as the trunk of a vehicle, a table or the ground and be able to adjust height to a desired height suitable for changing the diaper of a baby on the diaper changing station 200. In some embodiments, the adjustable support system 252 can be adjustable to a plurality of discrete heights, including the first height, the second height, and the third height. In some embodiments, the diaper changing station can be adjusted to more or fewer heights than those illustrated in FIGS. 13-16.

In some embodiments, the flaps 208 and 210 can be flexible flaps that can be opened to expose and closed to protect the pad 204. In some embodiments, the flaps 208 and 210 can include one or more rigid components in addition to flexible components. In some embodiments, the flaps 208 and 210 can be substantially entirely rigid so long as they are suitable for covering and exposing the pad 204 as appropriate. In some embodiments, the flaps 208 and 210 can be replaced by a single flap that covers substantially all of the pad 204.

Figure 17:
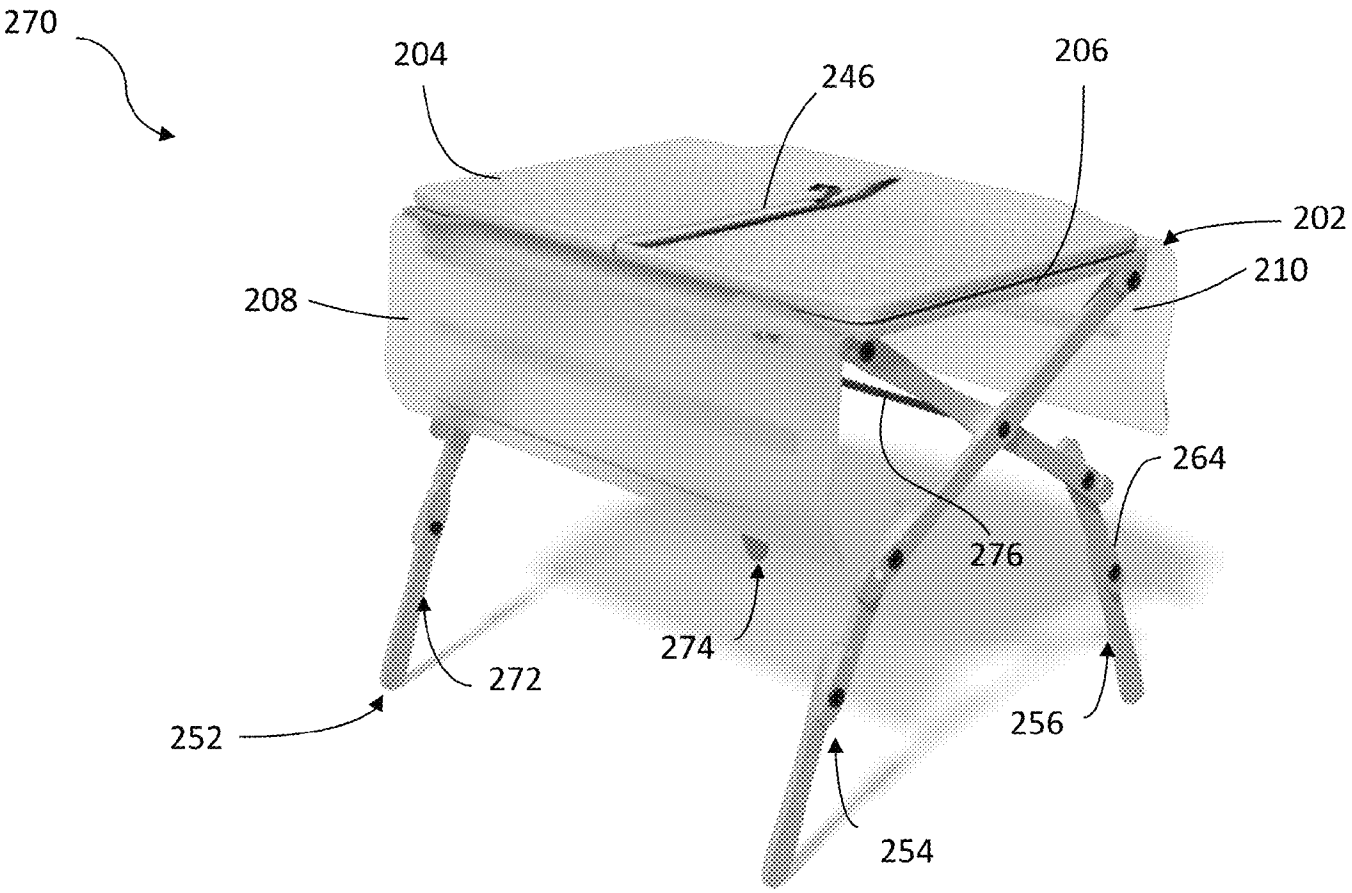
FIG. 17 is a perspective view of an alternative embodiment of a diaper changing station with legs extended to a third height.

FIG. 17 is a perspective view of a diaper changing station 270, which can be similar to the diaper changing station 200 described above. The diaper changing station 270 is illustrated in FIG. 17 with the adjustable support system 252 extended to the third height. In some embodiments, the adjustable support system 252 can include a first pair of legs 254 and 256 at a first end of the diaper changing station 270 and a second pair of legs 272 and 274 at a second, opposite end of the diaper changing station 270. A support bar 276 can extend from a pivot point of the legs 254 and 256 to a pivot point of the legs 272 and 274. The legs 272 and 274 can be configured and connected in a manner similar to that of the legs 254 and 256. In other embodiments, the diaper changing station 270 can have an adjustable support system configured for adjusting between heights that is different than the illustrated system.

Figure 18:
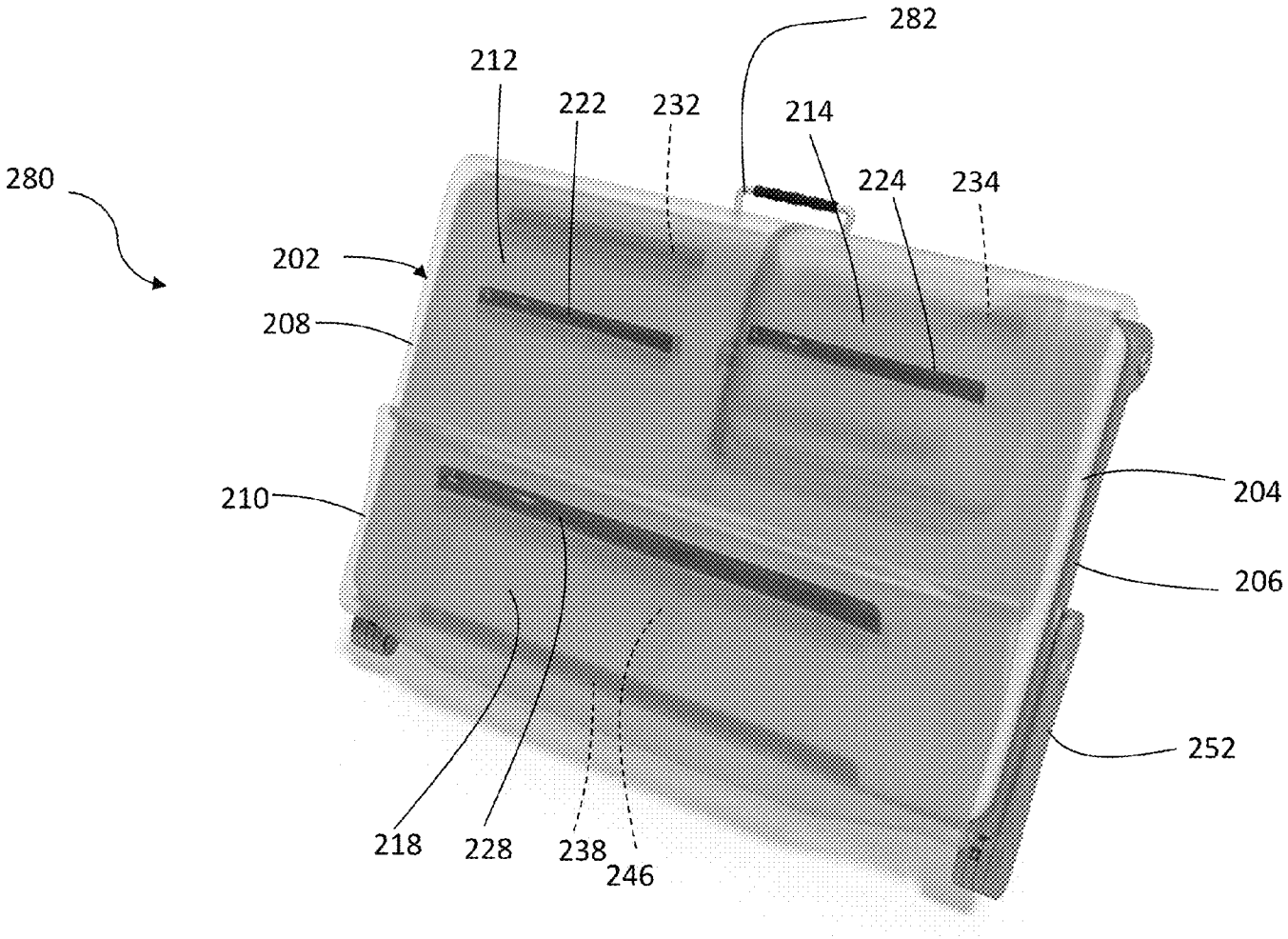
FIG. 18 is a perspective top view of an alternative embodiment of a diaper changing station with legs folded.

FIG. 18 is a perspective top view of a diaper changing station 280, with the adjustable support system 252 folded on a storage position. The diaper changing station 280 can be similar to the diaper changing stations 200 and 270 described above. In some embodiments, the diaper changing station 280 includes the storage pockets 212, 214, and 218 on the cover 202. The storage pockets 212 and 214 can be positioned on the flap 208 and the storage pocket 218 can be positioned on the flap 210. In some embodiments, a storage pocket can cover all or substantially all of an area of a flap, such as the storage pocket 218 on the flap 210. In some embodiments, a storage pocket can cover less than all of the area of a flap, such as the storage pocket 212 or the storage pocket 214 of the flap 208.

In some embodiments, the cover 202 can be made of a transparent or translucent material so as to allow a user to see contents of the storage pockets 212, 214, and 218. FIG. 18 illustrates the cover 202 as being translucent, with zippers of the openings 232, 234, and 238 being partially visible on the bottom of the storage pockets 212, 214, and 218. The storage pockets 212, 214, and 218 can be accessed from the openings 222, 224, and 228 when the cover 202 of the diaper changing station 280 is in the closed position (as illustrated in FIG. 18) and can be accessed by the openings 232, 234, and 238 when the cover 202 of the diaper changing station 280 in the opened position (similar to that illustrated in FIGS. 14-17).

In some embodiments, the storage pockets 212, 214, and 218 can be made of a flexible material suitable for allowing the storage pockets 212, 214, and 218 to stretch when filled or partially filled with contents. This can allow the storage pockets 212, 214, and 218 to have a variable storage volume, with a relatively large volume when filled with a large amount of contents and a relatively small volume when filled with less or no contents. The storage pocket 214 is illustrated in FIG. 18 as stretched due to contents (not shown) being positioned therein. The storage pockets 212 and 218 are illustrated in FIG. 18 as being relatively flat and unstretched, with little or no contents placed therein.

The storage pockets 212, 214, and 218 can be sized to contain materials needed for changing a baby, including diapers, wipes, and/or a change of clothing. In one embodiment, the storage pockets 212, 214, and 218 can be sized to contain a standard package of wipes and up to 40 diapers. In other embodiments, the storage pockets 212, 214, and 218 can be sized with a larger or smaller capacity as suitable for the application.

In some embodiments, the diaper changing station 200 can include a handle 282. The handle 282 can be a carrying handle, for carrying the diaper changing station 200 when the diaper changing station 200 is in a closed position. The handle 282 can be connected to an edge of the diaper changing station 200, such as an edge of the platform 206, so as to connect to a rigid portion of the diaper changing station 200 with relatively little or no interference with the function of the cover 202, pad 204, and adjustable support system 252.

Figure 19:
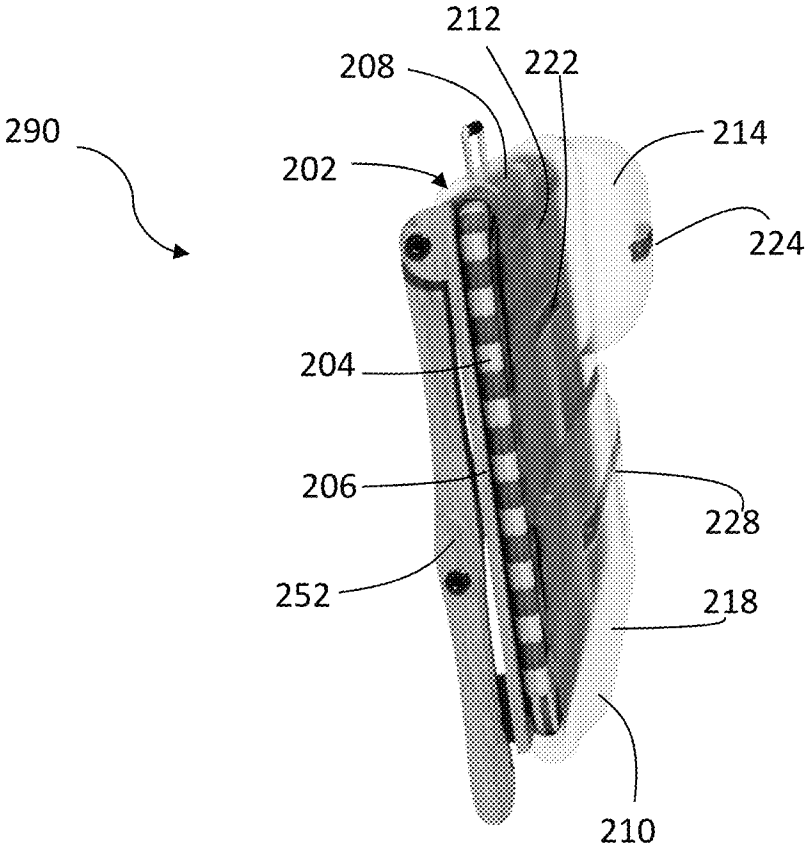
FIG. 19 is a perspective end view of an alternative embodiment of a diaper changing station with legs folded.

FIG. 19 is a perspective end view of a diaper changing station 290 with the adjustable support system 252 collapsed and folded. The diaper changing station 290 can be similar to the diaper changing stations 200, 270, and 280 described above. The platform 206 and the adjustable support system 252 can be made at least partially of wood, as illustrated in FIG. 19. Using wood for structural components such as the platform 206 and the support system 252 can create a relatively strong structure with a look that can be aesthetically pleasing to users fond of wood. In some embodiments, the diaper changing station 290 can be constructed of material other than wood. In some embodiments, the platform 206 and the adjustable support system 252 can be formed of polymer materials. Using polymer materials can create a structure that is relatively strong, light weight, and easily formed. In some embodiments, the platform 206 and the adjustable support system 252 can be formed of metal. Using metal can create a structure that is also relatively strong, light weight, and easily formed. For example, legs of the adjustable support system 252 can be cut from sheet metal (such as aluminum) and riveted or bolted together at hinge points. In some embodiments, the diaper changing station 290 can be formed of a variety of materials, such as polymers, metals, woods, and/or fabrics suitable for the applications.

A number of embodiments of the invention have been described. Nevertheless, it will be understood that various modifications may be made without departing from the spirit and scope of the invention. For example, the size and shape of the housing and other components can be modified as suitable for a given application. Additionally, components of different embodiments can be combined and modified, such as adding drawers to the diaper changing station 200 or adding features of the adjustable support system 252 to the diaper changing station 10. Moreover, while features are described above using the example of use with a baby, the diaper changing stations can be sized and configured for use with children of varying ages that can benefit from such diaper changing stations. Accordingly, other embodiments are within the scope of the following claims.

What is claimed is:

1. A portable diaper changing station comprising:

a platform structure having a top that defines a baby changing surface that is substantially concave in at least one direction and configured for receiving and supporting a baby during a diaper changing process, wherein the platform structure comprises a rigid platform and a resilient pad positioned on top of and supported by the platform structure; and a support structure connected to and configured for supporting the platform structure, wherein the support structure is extendable from a storage position to a first extended position suitable for supporting the platform structure at a first height and a second extended position suitable for supporting the platform structure at a second height that is greater than the first height.

2. The portable diaper changing station of claim 1, wherein the support structure comprises a plurality of pivotable legs.

3. The portable diaper changing station of claim 1, wherein the support structure comprises a plurality of legs with a plurality of leg segments, wherein the plurality of leg segments comprises a first set of leg segments extendable to the first extended position to raise the platform structure to the first height and a second set of leg segments that are connected to the first set of leg segments and are extendable to the second extended position to raise the platform structure to the second height.

4. The portable diaper changing station of claim 1, and further comprising:

a cover connected near an edge of the platform structure so as to be foldable between a closed position that at least partially covers the baby changing surface and an open position that exposes the baby changing surface, wherein the cover includes at least one storage pocket.

5. The portable diaper changing station of claim 4, wherein the at least one storage pocket comprises a first opening positioned so as to allow access to the storage pocket when the cover is in the closed position and a second opening positioned so as to allow access to the storage pocket when the cover is in the open position, wherein the cover comprises a first fastener for selectively opening and closing the first opening and a second fastener for selectively opening and closing the second opening, wherein the cover comprises a first flap and a second flap, wherein the first and second flaps are connected to opposing edges of the platform structure, wherein the first and second flaps comprise flexible material, and wherein the platform structure comprises a substantially ridged material.

6. A portable diaper changing station comprising:

a platform structure having a top that defines a baby changing surface that is substantially concave in at least one direction and configured for receiving and supporting a baby during a diaper changing process; and a support structure connected to and configured for supporting the platform structure, wherein the support structure is extendable from a storage position to a first extended position suitable for supporting the platform structure at a first height and a second extended position suitable for supporting the platform structure at a second height that is greater than the first height, wherein the support structure comprises at least four legs, each comprising a plurality of pivotably connected leg segments that can be pivoted to selectively raise the portable diaper changing station from the storage position to the first extended position and the second extended position.

7. The portable diaper changing station of claim 6, wherein a first leg comprises first, second, and third leg segments with the second leg segment pivotably connected at its ends to each of the first and third leg segments, wherein a second leg comprises fourth, fifth, and sixth leg segments with the fifth leg segment pivotably connected at its ends to each of the fourth and sixth leg segments.

8. The portable diaper changing station of claim 7, wherein the first leg segment is pivotably connected to the fourth leg segment at or near middles of the first and fourth leg segments.

9. The portable diaper changing station of claim 7, wherein the first leg segment is pivotably connected to a first edge of the platform structure and the fourth leg segment is pivotably connected to a second edge of the platform structure that is opposite of the first edge.

10. A portable diaper changing station comprising:

a baby changing surface configured for receiving and supporting a baby during a diaper changing process;

a cover connected near an edge of the baby changing surface so as to be foldable between a closed position that at least partially covers the baby changing surface and an open position that exposes the baby changing surface, wherein the cover includes at least one storage pocket; and a support structure connected to and configured for supporting the baby changing surface, wherein the support structure is extendable from a storage position to a first extended position suitable for supporting a platform structure at a first height and a second extended position suitable for supporting the platform structure at a second height that is greater than the first height.

11. The portable diaper changing station of claim 10, wherein the cover comprises a first flap and a second flap, wherein the first and second flaps are connected to opposing edges of a platform of the portable diaper changing station, wherein the first and second flaps comprise flexible material, and wherein the platform comprises a substantially ridged material.

12. The portable diaper changing station of claim 10, wherein a first flap comprises first and second storage pockets and a second flap comprises a third storage pocket, wherein the first, second, and third storage pockets each have different sizes.

13. The portable diaper changing station of claim 10, wherein the at least one storage pocket comprises flexible material allowing the at least one storage pocket to have a variable storage volume that varies as a function of its contents.

14. The portable diaper changing station of claim 10, wherein the support structure comprises at least four legs, each comprising a plurality of pivotably connected leg segments that can be pivoted to selectively raise the portable diaper changing station from the storage position to the first extended position and the second extended position, wherein a first leg comprises first, second, and third leg segments with the second leg segment pivotably connected at its ends to each of the first and third leg segments, wherein a second leg comprises fourth, fifth, and sixth leg segments with the fifth leg segment pivotably connected at its ends to each of the fourth and sixth leg segments, wherein the first leg segment is pivotably connected to the fourth leg segment at or near middles of the first and fourth leg segments, and wherein the first leg segment is pivotably connected to a first edge of the platform structure and the fourth leg segment is pivotably connected to a second edge of the platform structure that is opposite of the first edge.

15. The portable diaper changing station of claim 10, wherein the support structure comprises a plurality of legs with a plurality of leg segments, wherein the plurality of leg segments comprises a first set of leg segments extendable to the first extended position to raise the platform structure to the first height and a second set of leg segments that are connected to the first set of leg segments and are extendable to the second extended position to raise the platform structure to the second height.

16. The portable diaper changing station of claim 10, wherein the baby changing surface is defined by a housing comprising first and second hingedly connected modules defining first and second drawer cavities and wherein first and second drawers are positioned in the first and second drawer cavities.

17. A portable diaper changing station comprising:

a baby changing surface configured for receiving and supporting a baby during a diaper changing process; and a cover connected near an edge of the baby changing surface so as to be foldable between a closed position that at least partially covers the baby changing surface and an open position that exposes the baby changing surface, wherein the cover includes at least one storage pocket, wherein the at least one storage pocket comprises a first opening positioned so as to allow access to the storage pocket when the cover is in the closed position and a second opening positioned so as to allow access to the storage pocket when the cover is in the open position.

18. The portable diaper changing station of claim 17, wherein the cover comprises a first fastener for selectively opening and closing the first opening and a second fastener for selectively opening and closing the second opening.

19. The portable diaper changing station of claim 17, and further comprising:

a support structure connected to and configured for supporting the baby changing surface, wherein the support structure is extendable from a storage position to a first extended position suitable for supporting a platform structure at a first height and a second extended position suitable for supporting a platform structure at a second height that is greater than the first height, wherein the platform structure comprises a rigid platform and a resilient pad positioned on top of and supported by the platform structure, and wherein the support structure comprises at least four legs, each comprising a plurality of pivotably connected leg segments that can be pivoted to selectively raise the portable diaper changing station from the storage position to the first extended position and the second extended position.

20. The portable diaper changing station of claim 17, wherein the cover comprises a first fastener for selectively opening and closing the first opening and a second fastener for selectively opening and closing the second opening, wherein the cover comprises a first flap and a second flap, wherein the first and second flaps are connected to opposing edges of a platform of the portable diaper changing station, wherein the first and second flaps comprise flexible material, wherein the platform comprises a substantially ridged material, wherein the first flap comprises first and second storage pockets and the second flap comprises a third storage pocket, and wherein the first, second, and third storage pockets each have different sizes.

* * * * *